US009925654B2

(12) United States Patent
Ragner

(10) Patent No.: US 9,925,654 B2
(45) Date of Patent: Mar. 27, 2018

(54) FOLDING MULTIWRENCHES

(71) Applicant: Gary Dean Ragner, Gainesville, FL (US)

(72) Inventor: Gary Dean Ragner, Gainesville, FL (US)

( * ) Notice: Subject to any disclaimer, the term of this patent is extended or adjusted under 35 U.S.C. 154(b) by 391 days.

(21) Appl. No.: 14/647,821

(22) PCT Filed: Aug. 15, 2013

(86) PCT No.: PCT/US2013/055208
§ 371 (c)(1),
(2) Date: May 27, 2015

(87) PCT Pub. No.: WO2014/028779
PCT Pub. Date: Feb. 20, 2014

(65) Prior Publication Data

US 2015/0336257 A1 Nov. 26, 2015

Related U.S. Application Data

(60) Provisional application No. 61/683,345, filed on Aug. 15, 2012.

(51) Int. Cl.

| | |
|---|---|
| ***B25F 1/00*** | (2006.01) |
| ***B25F 1/04*** | (2006.01) |
| ***B25G 1/04*** | (2006.01) |
| ***B25B 13/56*** | (2006.01) |

(52) U.S. Cl.
CPC ..... *B25F 1/003* (2013.01); *B25B 13/56* (2013.01); *B25F 1/04* (2013.01); *B25G 1/043* (2013.01)

(58) Field of Classification Search
CPC . B25B 23/0007; B25B 23/16; B25B 23/0071; B25B 13/04; B25B 13/08; B25B 13/56; B25B 13/481; B25F 1/04; B25G 1/043
USPC ..... 81/124.4, 124.3, 121.1, 177.6, 177.7, 81/125.1; 85/125, 125.1
See application file for complete search history.

(56) References Cited

U.S. PATENT DOCUMENTS

| | | | | |
|---|---|---|---|---|
| 1,793,714 A * | 2/1931 | Newberg | ..... | B25B 13/08 81/125.1 |
| 2,097,361 A * | 10/1937 | Bagley | ..... | B25B 13/04 81/177.6 |
| 2,738,694 A | 3/1953 | Boatright | | |
| 4,505,171 A | 3/1985 | Chang | | |

(Continued)

FOREIGN PATENT DOCUMENTS

| | | | | |
|---|---|---|---|---|
| GB | 2398264 A * | 8/2004 | ..... | B25B 13/461 |

*Primary Examiner* — Hadi Shakeri

(57) ABSTRACT

A folding multifunction wrench for tightening or loosening a plurality of different sized rotary fasteners, comprising at least two wrench heads attached to their own respective wrench arm with the wrench arms pivotally mounted together at a hinge and pivotal (foldable) to a smaller stowed position or extend to a larger operational position. Individual wrench arms can be used either as a wrench handle or as a wrench tool depending on which end of the wrench the user grasps. During use, the rotational axes of the gripping surfaces on the wrench head can be oriented within ten degrees of being perpendicular to the hinge axis of the two or more wrench arms, whereby torque can be transmitted across the hinge axis for turning the plurality of different sized rotary fastener.

19 Claims, 10 Drawing Sheets

(56) References Cited

U.S. PATENT DOCUMENTS

Figure 2A:
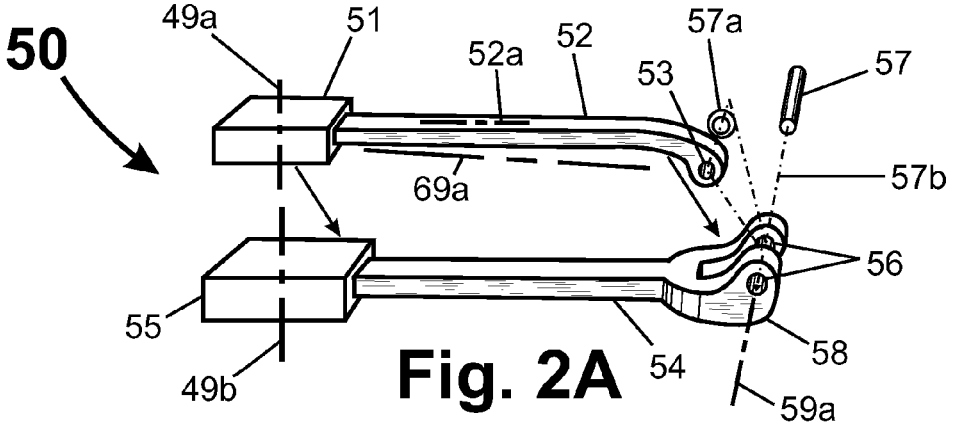

| | | | | |
|---|---|---|---|---|
| 5,172,614 | A * | 12/1992 | Monnet | B25B 13/04 81/119 |
| 5,450,774 | A * | 9/1995 | Chang | B25B 13/56 7/168 |
| 5,983,759 | A * | 11/1999 | Turner | B25B 13/08 81/125.1 |
| 6,655,239 | B1 | 12/2003 | Macor | |
| 6,959,628 | B2 | 11/2005 | Macor | |
| 7,024,970 | B2 | 4/2006 | Boman | |
| 7,975,578 | B2 | 7/2011 | Youtsey | |
| 8,161,847 | B1 | 4/2012 | Considine | |
| 8,302,510 | B2 | 11/2012 | Macor | |
| 8,474,353 | B1 * | 7/2013 | Thoman | B25G 1/007 81/177.6 |
| 8,701,524 | B2 | 4/2014 | Chang et al. | |
| 9,079,297 | B2 * | 7/2015 | Lance | B25B 13/04 |
| 2005/0284268 | A1 | 12/2005 | Chen | |
| 2006/0150784 | A1 * | 7/2006 | Hsieh | B25B 13/481 81/125.1 |
| 2007/0000359 | A1 | 1/2007 | Tansbo et al. | |
| 2009/0241740 | A1 | 10/2009 | Heagerty | |
| 2011/0120275 | A1 * | 5/2011 | Macor | B25B 13/04 81/124.5 |
| 2011/0197718 | A1 * | 8/2011 | Meholovitch | B25B 9/00 81/60 |
| 2012/0017729 | A1 | 1/2012 | Chang | |

* cited by examiner

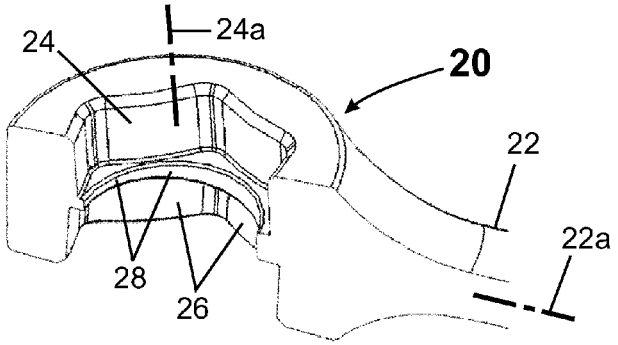
Fig. 1A - Prior Art
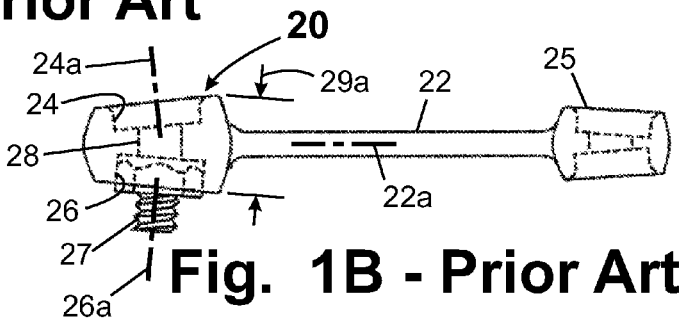
Fig. 1B - Prior Art
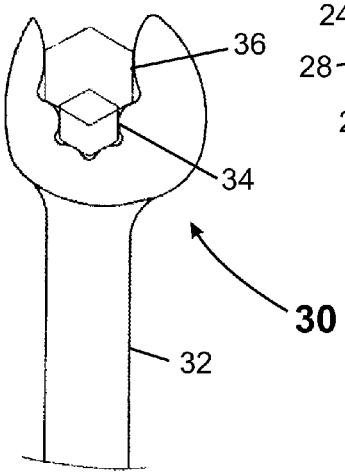
Fig. 1C
Prior Art
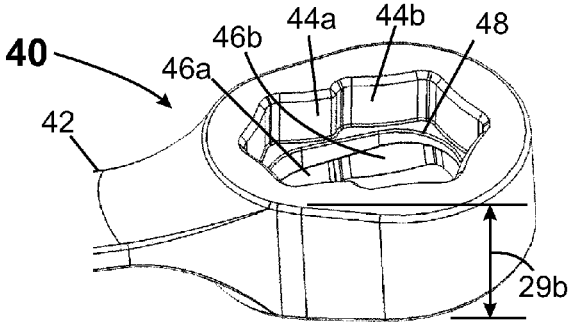
Fig. 1D - Prior Art
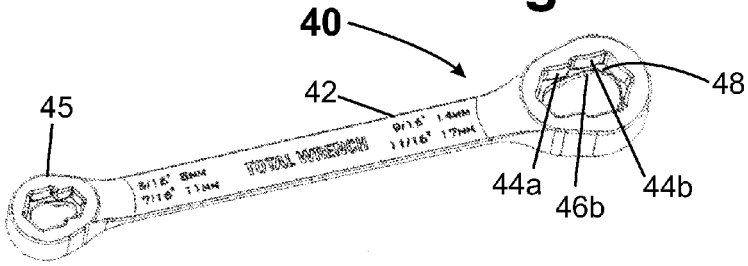
Fig. 1E - Prior Art

FOLDING MULTIWRENCHES

CROSS-REFERENCE TO RELATED APPLICATIONS

This Non-Provisional Application claims priority from PCT Patent Application PCT/US2013/055208 titled: "Folding Multiwrenches" filed on Aug. 15, 2013 and resulting in Publication WO 2014/028779 A1, and U.S. Provisional Application Ser. No. 61/683,345, filed on Aug. 15, 2012, titled: "Folding Multiwrenches".

BACKGROUND OF INVENTION

The field of this invention relates to wrenches for turning multiple sizes of rotary fasteners and comprise at least two wrenches attached to one another, and more specifically to multiwrench sets that comprise a pivotal hinge that allow the wrench to be fold to a compact stowed position for carrying and an extended position for use.

The present state of wrenches technology is very diverse and there are many different types and styles of wrenches. It turns out to be relatively difficult to precisely define the difference between a permanently attached wrench and an interchangeable socket wrench. For the purposes of this patent the term "wrench", "wrenches", etc. will be used to refer to rotary fastener gripping tools that are permanently fixed to the end of a tool arm. This is in contrast to socket wrenches which by their very nature have removable gripping tools (the socket) to allow multiple gripping tools to be interchanged with a single non-ratcheting wrench handle or a ratcheting wrench handle. Generally, sockets are closed at one end with a connector designed to removably attach the socket to a ratchet wrench or other wrench handle (normal socket and ratchet see everyone is familiar with). However, recently ratchet and socket sets have been designed with pass through sockets and in these designs the ratchet wrench is designed to grip the exterior of the socket instead of connecting to a square hole. These pass through sockets still have a rather large axial length (height or profile) which helps distinguish them from wrench heads which tend to have a much shorter profile (axial length of the gripping end of the wrench). Note that for duplexed wrenches and rotary wrench heads (i.e. Dog-Bone® wrenches) where two gripping surfaces are stacked above one another, the axial height can be as much as three times the diameter of the largest gripping surface on the wrench head.

Wrenches normally come in sets of seven or more sizes with box ends and/or open end wrench heads. Though some wrench sets are for specific purposes that may have as few as four or five different gripping surface size, the vast majority of wrench sets are sold with seven or more individual wrench sizes. Multiple sizes allows the user to tighten and loosen rotary fasteners (bolts, screws, nuts, specialty fasteners, and etc.) on many types of mechanisms. Most American homes have at least one set of wrench in their home. Prior art wrenches include a multitude of ways of providing torque to various rotary fasteners, and can includes a ratchet mechanism that can be bidirectional (selectively reversible) or unidirection (ratchets in only one direction). Wrenches are defined in this patent to include relatively low-profile wrenches that have a small vertically dimension compared to the length of a socket and ratchet combination during use, and/or defined as being a gripping surface permanently attached to a particular handle (wrench arm, or arm) during normal use (not easy removed from the handle). Such wrenches can get into vertically tight spaces that the socket and ratchet wrench combinations cannot. Examples of wrench heads can comprise low-profile wrench heads such as box-end wrench heads, open-end wrench heads, flare nut wrench heads, low profile adjustable wrenches (i.e. crescent style, and other low-profile adjustable wrenches), dual and quad wrench heads (back-to-back wrench heads, low-profile socket style wrenches, specific-size torque wrenches, spanner head wrenches, logger head wrenches, and other low-profile wrenches. The invention can also useful for medium-profile wrenches, such as, plumbers style wrenches, dog bone wrench heads, and other medium-profile wrenches. Many of these wrench types can also include a low profile ratchet mechanism if desired. Wrenches like Dog-Bone® wrenches (Ready Wrench®), plumbers wrenches, and other thicker wrenches are on the upper end for wrench thickness that can still allow convenient folding of the multiwrench to a compact state using the folding technology disclosed herein. These thicker wrench heads can be used with off-axis folding so that the thicker wrench heads can fold to the side of each other for a more compact stowed position (see FIG. 2D). Further, the use of the term "wrench" and "wrenches" in this patent will not include permanently attached wrench heads with a profile taller than similarly sized Dog-Bone® wrenches (not more than approximately three times the diameter of the gripping surfaces). This distinguish the disclosed multiwrench designs from the multi-ratchet socket designs seen in U.S. Provisional application Ser. No. 61/628,143, filed on Oct. 25, 2011, titled: "Folding Dual Ratchet Wrench" by the Applicant, which have sockets and ratchet head combinations that are greater in length than three times the gripping surface diameter of that socket, so that they can be used as an effective extension to the handle (socket has a profile height similar to the length of the center handle).

The wrench heads disclosed in this patent can use three different styles of wrenches: 1) single direction ratchets, 2) reversible ratchets, or 3) no ratchet mechanism at all. These three styles of wrenches are compatible with the presented folding multiwrench invention in various combinations. Each of these wrench styles can use one or more wrench head types, such as, 1) box-end head, 2, flare nut head, 3) open-end head, 4) spanner head, 5) bung head, 6) dog bone style rotary head (Ready Wrench®), 7) duplex head (two sizes facing in opposite directions) (U.S. Pat. D278,510), 8) overlapped heads (U.S. Pat. Nos. 5,313,860; 6,131,492), 9) overlapped duplexed heads (4-sizes) (U.S. Pat. No. 7,926, 393), 10) rotary dial head (U.S. Pat. No. 4,694,711), 11) multi-size ends (box and open), 12) adjustable box-ends (variable size opening) (U.S. Pat. Nos. D303,916; 4,838, 132), 13) adjustable open-ends (Crescent®, plumbers, etc.), 14) self-clamping (U.S. Pat. Nos. 701,462; 897,665; 1,363, 274; 3,290,970; 3,572,190; 4,048,456; 4,594,922; 6,311, 586), 15) adjustable logger head (bionic wrench), 16) Channellock® style pliers, and 17) other specialty wrenches. This list of wrench head types is not all inclusive, but gives the reader a good idea of the types of wrench heads that are appropriate for use with the disclosed folding multiwrench. For example, "Pivotal Double Nested Wrench Ends" disclosed in U.S. Pat. Appl. 61/806,877 by the Applicant can be used with any of the folding multiwrench designs disclosed within this patent. The wrench heads types 6) through 17) can be considered multi-sized wrench heads and are the type of wrench head designs preferable for used with the disclosed folding multiwrench. Each of these wrench head types should be considered possible candidates for each wrench head discussed in this patent. Wrench types 1) through 5) can still be used with the disclosed multiwrench for some of the wrenches, but using multi-sized wrench heads will reduce the number of wrench arms and wrench heads needed for a particular wrench set, and thus makes the folding multiwrench more ergonomic.

These wrench head styles and types can each come in a variety of wrench gripping surfaces for use with different types of fasteners. The wrench gripping surfaces commonly used today comprise: 1) four-point standard (square shape), 2) six-point standard (hexagon shape), 3) twelve-point standard (double hexagon), 4) twelve-point spline, 5) lobed gripping surfaces (both six and twelve point), 6) saw toothed surfaces, 7) asymmetric gripping surfaces, 8) variations on these basic shapes and 9) many other shape specialty shapes for various purposes. This list of gripping surfaces is not exhaustive and many other gripping surface designs exist in the prior art that can be used with the disclosed folding wrench system.

The disclosed folding multiwrenches define one or more hinges designed to fold the wrench into a compact position for storage. Besides the hinges designed to fold the wrench into a stowed position, each wrench head can comprise a pivotal hinge near the wrench head so that the wrench head can be angled with respect to its arm to turn a rotary fastener (bolts, screws, nuts, and etc.) at various angles. The distance between these pivotal hinges and their wrench head is normally made small so that the wrench head can fit into tight spaces (see Figure-8® pivotal hinges 163 and 167 in FIG. 6C). Both the folding hinge(s) and the wrench head pivotal hinges can include a stabilizing means that provide sufficient friction and/or a locking action for the hinge so that the wrench can hold a particular position during use. Friction devices can comprise smooth motion friction systems (see FIG. 8C) and/or multiple stable position devices (see FIG. 7C, hinge assembly 190). The term "folding hinge" is used herein to particularly identify a hinge that is used to fold the multiwrench's arms, as opposed to other hinges like wrench head hinge 154*e* which is used to pivot wrench head 154 for use. These hinges can also comprise a locking mechanism to lock the wrench arms and/or head at particular angle (see FIG. 7C, hinge assembly 195) with respect to the rest of the multiwrench.

The disclosed invention combines a full set of wrench sizes into a single folding tool, that can fold over on itself like a book, or tri-fold like a pamphlet, to significantly reduce the overall stowed size of the folding multiwrench set. In many cases this means the multiwrench folds approximately in half (see FIGS. 2A-C, 3A-B, and 6A-C). In other configurations, the multiwrench arms can have slightly different lengths to allow the wrench heads to store adjacent, or nest next to, each other along the length of the arms (see FIGS. 3C, 5A-B, and 7A-B) instead of on top of the other wrench heads. Similarly, the folding multiwrench set can pivot the wrench heads to the side at an angle to allow the wrench heads to fold next to each other on the side for more compact storage (see FIG. 2D). The disclosed invention provides one or more pivotal hinges near the middle of the wrench to allow the multiwrench to fold into a substantial more compact configuration for storage. The disclosed invention also can provide two hinges that allow a tri-fold where a center handle is used that is approximately a third of the length of the fully extended wrench. Each hinge may include a friction mechanism and/or a locking mechanism to stabilize and/or hold the arms in a particular configuration during use. Prior art shows many friction and locking mechanisms that are commonly used with wrenches, ratchets, and other tools similar to the disclosed folding multiwrench. Both friction and locking mechanism examples are shown in this patent, but these example designs are only a small sampling of the many types of holding mechanisms for hinges and pivots that are presently designed for hand tools. Nearly all the hinge stabilizing mechanisms designed for hand tools can be easily made to work on the disclosed folding multiwrench.

Most combinations of wrench style, type and gripping surface shape can be used to make various folding multiwrenches using the disclosed technology. Also, combinations of different styles and/or types can be combined into a single multiwrench if desire. For example, a crescent type wrench could be combined with a full set of eight box head type wrench sizes (e.g. four duplexed wrench heads) to provide a more versatile multiwrench (see FIG. 6B).

PRIOR ART

Many multiwrench designs exist in the prior art that provide multiple wrench sizes in a single tool, however only two were found that show a pivotal tool arm and wrench head design that place the turning axis of a particular wrench head gripping surface substantially perpendicular to both the longitudinal axis of its wrench arm, and the pivotal axis of its folding hinge, and also having the longitudinal axis of the wrench arm of multi-sized wrench heads substantially perpendicular to the folding hinge axes of the multiwrench.

U.S. Pat. No. 8,161,847 to Considine shows " . . . a socket wrench device having multiple adjustable fastener engagement tool ends. A pair of ratchet engagement heads are pivotally secured in respective rotational and supportive orientation with extending handles pivoted together at their free ends to afford multiple socket engagement orientation by compound pivot and socket rotation within a single hand tool configuration." However, though Considine shows pivoting the ratchet heads together, or toward each other, he does not appear to teach pivoting the ratchet wrench heads together and adjacent for a stowed position nor does his design appear capable of the acute angle needed to fold the handles substantially parallel, nor does he appear to suggest that this would be useful for his invention. From FIG. 4 in Considine's patent we can see that his construction will only allow handle 11 to pivot slightly past a right angle before hinge paw 13 makes contact with handle 12 (wrench arm) to stop further pivoting of the handles and ratchets together. Considine further does not teach providing multiple wrench sizes on each tool handle, and thus his design can only provide two sizes, not a full set of wrench sizes as the Applicant's invention can. The Applicant's design can provide eight or more wrench sizes in a single foldable pocket ready tool with two, three, four, five, or more pivotal tool handles.

U.S. Pat. No. 2,097,361 to Bagley shows " . . . a selective foldable wrench, that is to say a wrench having a plurality of foldable portions, each being provided adjacent the free end thereof with a aperture for application to a nut or bolt while the balance of the wrench functions as a handle for rotary manipulation of the object engaged." Bagley's design can fold together for storage, his design must use a single gripping surface size (aperture) per wrench arm (handle), and thus requiring seven arms to provide seven gripping surface sizes (apertures). Five of Bagley's wrench arms are "U" shaped arms comprising two separate physical arms. With the Applicant's folding design, eight gripping surface sizes can be provided with only two wrench arms (see FIGS. 7A-B), saving considerable weight compared to Bragley's design. The Applicant's invention can also provide three, four, five, and/or more pivotal wrench arms (handles) depending on the needed wrench.

SUMMARY

The disclosed Folding MultiWrench can combines a full set of wrenches into one compact tool or multiwrench. The invention has three unique features. First, at least one of the folding wrenches is a multi-wrench that provides more than one wrench size, either by multiple fixed sizes or by being adjustable wrench. Second, the separate wrenches can each be used as a wrench or as an extended handle portion depending on the configuration of the wrenches. Third, the pivotal axis for each folding hinge is angled substantially perpendicular to the axis of a gripping surface engaging a rotary fastener and the longitudinal axis of its respective wrench arm, while at the same time, the longitudinal axis of the wrench arm is substantially perpendicular to the axis of rotation of the gripping surface. In other words all three axes (rotational axis of gripping surface, longitudinal axis of the wrench arm, and folding axis of the hinge) are all substantially perpendicular to each other. This third feature allows the pivotal axis of the wrench to transfer torque from one wrench arm or head to the other wrench head to turn a rotary fastener without needing a locking mechanism for the hinge. Placing the hinge near the middle of the extended wrench allow for a very compact wrench set to fold out into a full sized wrenches. The multiwrench can have one or more stowed configurations and can have several extended configurations. The exact number of stowed and extended configurations depends on the number of separate wrenches, the number of hinge joints, and their arrangement on the multiwrench.

Present technology allows wrench head to provide more than one distinct wrench size, or be adjustable to many sizes as is seen in the prior art or variations on the prior art. Each folding multiwrench set has a stowed position where the wrench set is significantly reduced in size by at least one third compared to when it is extended for use.

Objectives and Advantages

Accordingly, several objects and advantages of my invention are:

a) To provide a multiwrench set that can fold to less than sixty-five percent (<65%) of its fully extended length when not being used.

b) To provide a multiwrench set that can fold to less than sixty percent (<60%) of its fully extended length when not being used.

c) To provide a multiwrench set that can fold to less than fifty-five percent (<55%) of its fully extended length when not being used.

d) To provide a multiwrench set that can fold to less than fifty percent (<50%) of its fully extended length when not being used.

e) To provide a multiwrench set where all the wrenches are permanently attached to the wrench set so that the wrenches cannot separated from the multiwrench set during use.

f) To provide a multiwrench with two or more wrench arms with at least two gripping surface sizes (total of at least four gripping surface sizes).

g) To provide a multiwrench set where two or more wrench arms are pivotally attached to one another, wherein each wrench arm can be pivoted for use of its tool end (wrench head) while the other wrench arm(s) can be used as an extended grip handle for the wrench arm being used.

h) To provide a multiwrench set where two or more wrenches are pivotally attached to one another, wherein each wrench can be pivoted for use while the other wrenches can be used as a handle without the hinge being locked in place (i.e. pivot axis is substantially perpendicular to applied torque).

i) To provide a multiwrench set where two or more wrenches are pivotally attached to one another, wherein the pivotal axis is angled with respect to the wrenches so that torque can be transferred from one wrench to the another during use without the need for a locking mechanism on the pivotal axis to prevent pivoting of the wrenches with respect to each other during use.

j) To provide a multiwrench set where two hinge axes are placed substantially parallel to one another on a central housing. Wherein each hinge pivotally attaches one or more wrench arms, and where the wrench arm are pivotal one-hundred eighty degrees or more with respect to the central housing.

k) To provide a multiwrench set where two hinge axes are placed substantially parallel to one another on a central housing. Wherein each hinge pivotally attaches one or more wrench arms, and where the wrench arm are pivotal between two different stowed positions that allow all the wrench sizes to be used while in one or the other stowed positions.

l) To provide a folding multiwrench that allows all the wrench sizes to be used when in its stowed position.

m) To provide a multiwrench set where two hinge axes are placed substantially parallel to one another on a central housing. Wherein each hinge pivotally attaches one or more wrench arms, and the central hub is attached to an additional wrench arm or is integral with the additional wrench arm.

n) To provide a multiwrench set that can fold to less than sixty-five percent (<65%), sixty percent (<60%), fifty-five percent (<55%), and/or fifty percent (<50%) of its fully extended length for stowage and where the multiwrench has two or more wrench heads with a turning axis designed to align with the axis of a rotary fastener for applying a torque to that fastener. Wherein the turning axis of the wrench heads are pivotable to at least sixty degrees out of alignment with it respective arm's longitudinal axis.

o) To provide a folding multiwrench wherein each wrench arm has three operational modes comprising a stowed mode (position) for compact storage, a handle mode where the wrench arm is used as a handle of the wrench, and an extended use mode where the wrench head of that arm is used to apply torque to a rotary fastener.

p) To provide a folding multiwrench wherein each wrench arm has three operational modes comprising a stowed position with operational mode where all the multiwrench's wrench sizes can be use while stowed (with the arms in their stowed position the wrenches are operational), an extended handle mode where the wrench arm is used as an extended handle for applying maximum torque to the multiwrench, and an extended operational mode for connecting to a rotary fastener and providing maximum torque.

q) To provide a folding multiwrench wherein each wrench arm has four operational modes comprising a first stowed position with operational mode where some of the wrench sizes can be use (very-short handle position 1), a second stowed with operational mode where the other wrench sizes can be used (very-short handle position 2), an extended handle mode where the arm is used as an extended handle, and an extended operational mode where the wrench head and arm are used to apply torque to a rotary fastener.

r) To provide a folding multiwrench wherein each wrench arm has four operational modes comprising: a stowed mode (position) for compact storage, a short handle mode (multiwrench is partially extended), an extended handle mode where the wrench arm is used for providing maximum torque to the multiwrench, and an operational mode where the wrench arm's wrench head is used to turn a rotary fastener.

s) To provide a folding multiwrench wherein each wrench arm has four operational modes comprising a stowed position and operational mode (very-short handle position) where all the multiwrench's wrench sizes can be use while stowed (operates as stowed handle and/or operational wrench in the same stowed position), a short handle position (partially extended wrench arms), an extended handle position for providing maximum torque to a wrench head, and an operational mode where the wrench head and arm are used to apply torque to a rotary fastener.

t) To provide a folding multiwrench with two or more wrench arm pivotally connected at one end and a multi-size wrench head mounted to each arm at the other end.

u) To provide a folding multiwrench with two or more wrench arm each with an overlapped duplex wrench head at one end, wherein wrench arms are pivotally connected at the other end to provide a folding multiwrench with eight or more wrench sizes.

v) To provide a folding multiwrench with four or more wrench arm each with a duplex wrench head and pivotally connected to each other to provide a folding multiwrench with eight or more wrench sizes.

w) To provide a folding multiwrench with four or more wrench arm each with a quad wrench head (four fixed sizes) on one end and pivotally connected to each other at the other end, wherein eight or more wrench sizes in both metric and standard are provided (sixteen or more fixed wrench sizes).

x) To provide a folding multiwrench with four or more wrench arm each with a quad wrench head (four fixed sizes) on one end and pivotally connected to each other at the other end, wherein eight or more wrench sizes can be from box-end style wrench heads, and eight or more wrench sizes can be from open-end style wrench heads.

y) To provide a folding multiwrench with two or more wrench arms each with an adjustable wrench head for a full range of sizes, wherein the wrench arms are pivotally connected together.

z) To provide a folding multiwrench with two or more wrench arms each where at least one arm comprises an adjustable wrench head that provides a full adjustable range of sizes, wherein the wrench arms are pivotally connected together.

aa) To provide a multiwrench with two or more wrench arms each with a wrench head having two or more sized gripping surfaces and at least one folding hinge connecting all the wrench arms together into a single tool. Wherein each wrench arm defines a longitudinal axis that is substantially perpendicular to both the rotational axis of its gripping surfaces, and its folding hinge.

bb) To provide a multiwrench with two or more wrench arms each with a wrench head having two or more sized gripping surfaces and at least one folding hinge connecting all the wrench arms together into a single tool. Wherein each wrench arm defines a longitudinal axis that is substantially perpendicular to both the rotational axis of its gripping surfaces, and its folding hinge. And wherein the rotational axis of the gripping surfaces are substantially perpendicular to their respective folding hinge to allow use of the gripping surfaces without requiring a locking mechanism on the folding hinge(s).

cc) To provide a folding wrench head comprising a duplex wrench hub, a ratchet housing, a reversible ratchet mechanism and a pivotal hinge, wherein the duplex wrench hub provides two sizes of wrenches and can be turned by the reversible ratchet mechanism in either direction. The pivotal hinge is connected to a wrench arm on a multi-arm multiwrench.

dd) To provide a folding multiwrench with two wrench arms and a center handle, wherein each arm defines a multi-size wrench head on one end of the arm, wherein the center handle defines a first and second hinge, wherein one wrench arm is pivotally attached to the first hinge, and the other wrench arm is pivotally attached to the second hinge, wherein the center handle is significantly shorter than the wrench arms.

ee) To provide a tri-folding multiwrench with two wrench arms and a center handle, wherein each arm defines a multi-size wrench head on one end of the arm, wherein the center handle defines a first and second hinge, wherein one wrench arm is pivotally attached to the first hinge, and the other wrench arm is pivotally attached to the second hinge, wherein the center handle is approximately the same length as the wrench arms or approximately the same length as the combined length of the wrench arm and wrench head combinations.

ff) To provide a tri-folding multiwrench that folds two wrench arms on the same side of the center handle.

gg) To provide a tri-folding multiwrench that folds wrench arms on opposite sides of the center handle.

hh) To provide a tri-folding multiwrench with two angled wrench arms each with a duplexed wrench head, wherein both sides of the duplexed wrench heads can be used while in its folded (stowed) position.

ii) To provide a tri-folding multiwrench with two angled wrench arms each with a quad wrench head, wherein both sides of the quad wrench heads can be used while in its folded (stowed) position.

jj) To provide a multiwrench one or more wrench arms comprise a secondary hinge for mounting a second wrench arm with a wrench head.

kk) To provide a tri-folding multiwrench with two wrench arms each with a duplexed wrench head, wherein the center handle is angled so that the duplexed wrench heads pivot to the side when folded, wherein both sides of the duplexed wrench heads can be used while in its folded (stowed) position.

ll) To provide a tri-folding multiwrench with two angled wrench arms each with a quad wrench head, wherein the center handle is angled so that the quad wrench heads are pivoted to the side when folded, wherein both sides of the duplexed wrench heads can be used while in its folded (stowed) position.

DRAWING FIGURES

FIG. 1A Prior Art—duplex box-end wrench head (two wrench sizes)

FIG. 1B Prior Art—two duplexed box-end wrench heads angled at −15 deg and +15 degrees.

FIG. 1C Prior Art—Overlapped wrench sizes (two sizes overlapped on an open-end wrench head).

FIG. 1D Prior Art—overlapped duplex wrench head (four size overlapped duplexed wrench head).

FIG. 1E Prior Art—Eight-sizes wrench with the overlapped duplex wrench head 40 seen in FIG. 1D. The wrench has four sizes on each wrench end (quad wrench heads) with overlapped duplex wrench head on each end).

FIG. 2A Disassembled view of folding multiwrench 50 with one hinge and two folding arms.

Figure 2B:
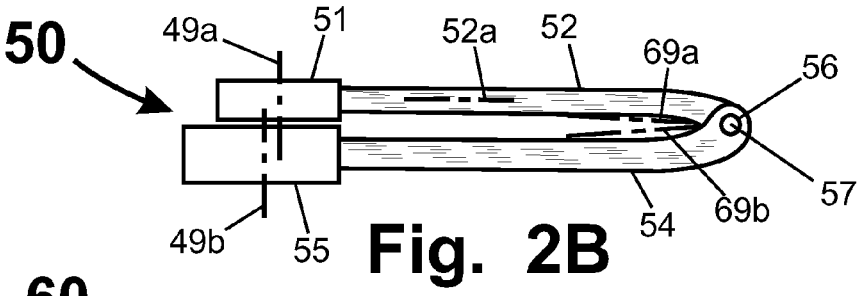

FIG. 2B Assembled side view of multiwrench 50 in FIG. 2A.

Figure 2C:
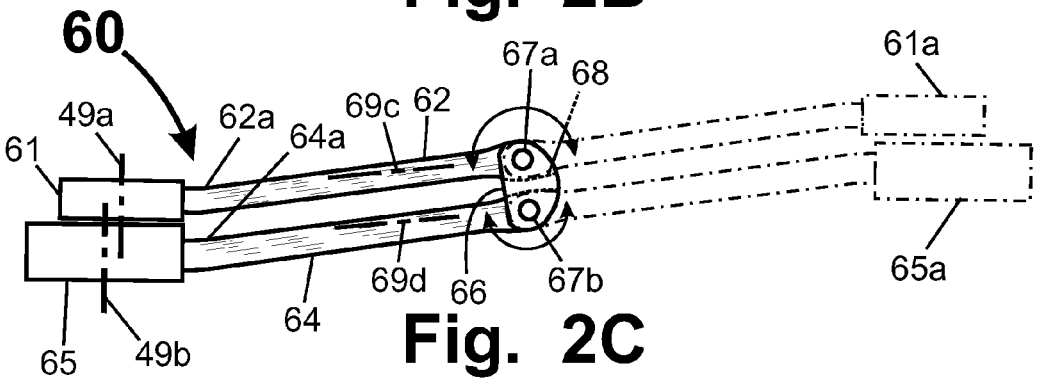

FIG. 2C Side view of multiwrench 60 with one hinge and two arms with angled ends.

Figure 2D:
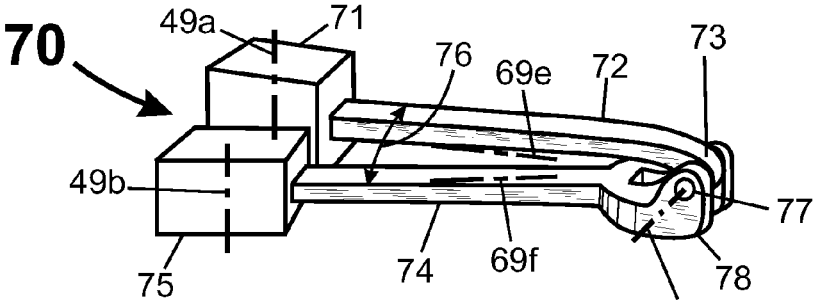

FIG. 2D Perspective view of multiwrench 70 with one hinge and two arms, wherein the arms are angled with respect to each other to fold the wrench heads to the side of each other.

Figure 3A:
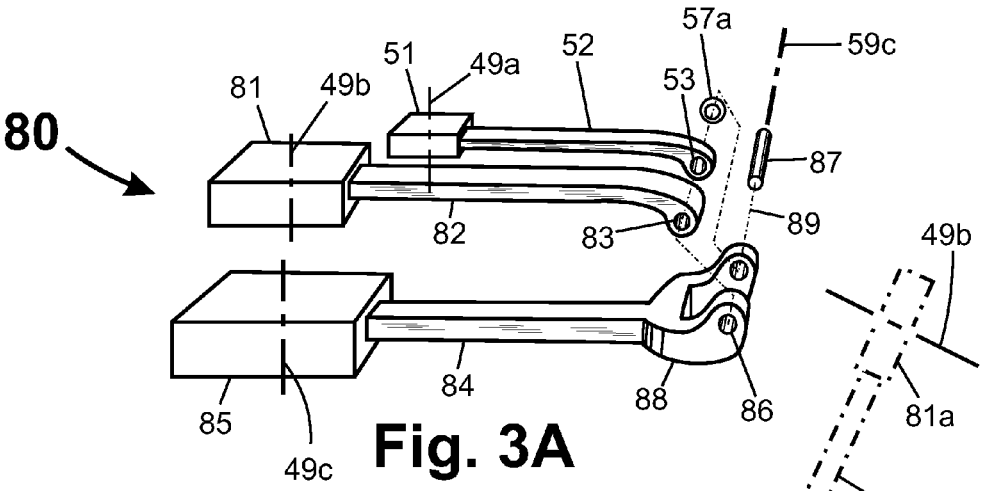

FIG. 3A Disassembled view of folding multiwrench 80 with one hinge and three tool arms.

Figure 3B:
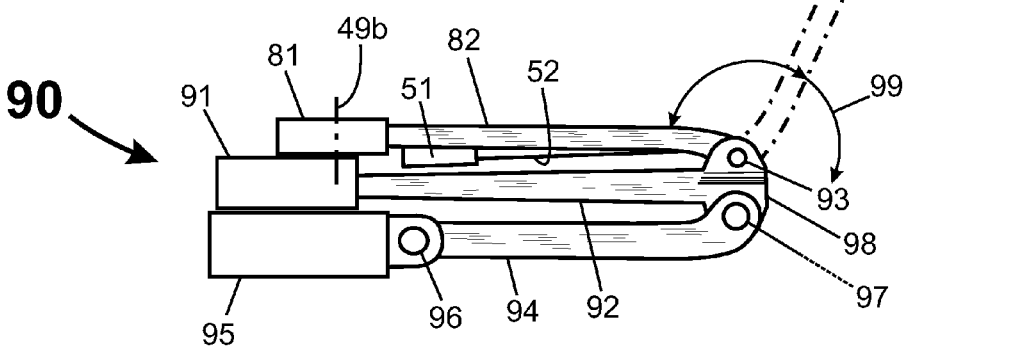

FIG. 3B Side view of folding multiwrench 90 with two substantially parallel hinges and four tool arms.

Figure 3C:
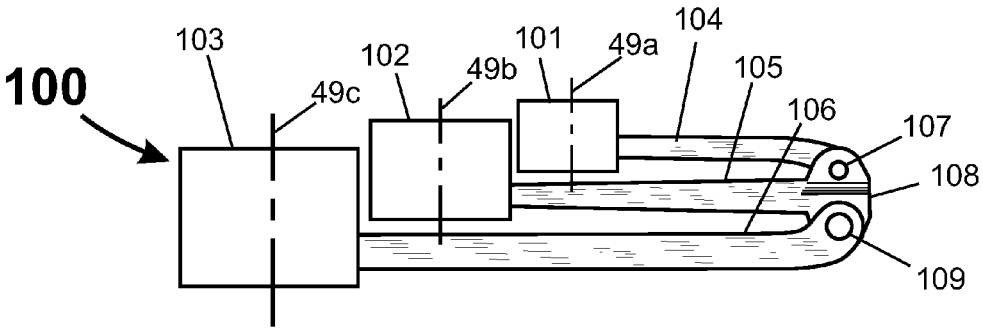

FIG. 3C Side view of folding multiwrench 100 with two substantially parallel hinges and three different length arms to fold medium height tool heads next to each other longitudinally (nested).

Figure 4A:
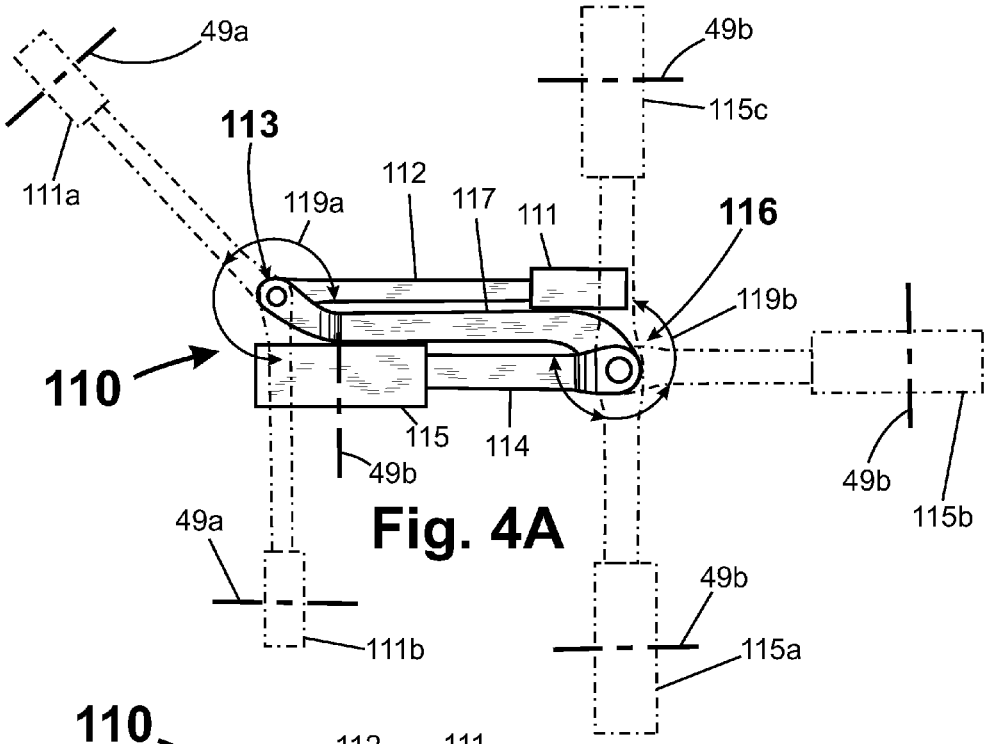

FIG. 4A Side view of tri-fold multiwrench 110 with two hinges, a center handle and two wrench arms.

Figure 4B:
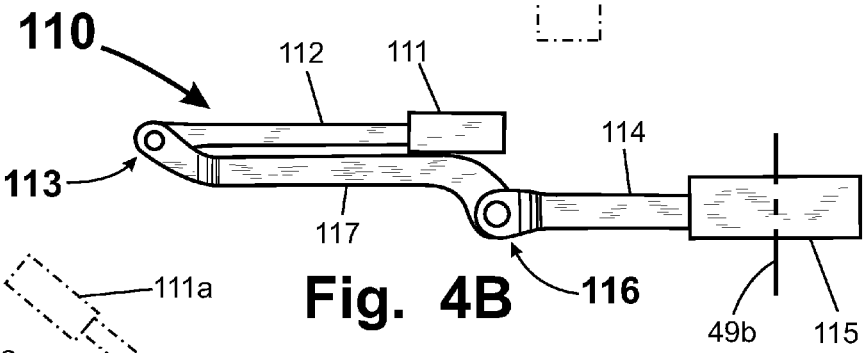

FIG. 4B Side view of tri-fold multiwrench 110 with largest wrench extended for use and arm folded to its short length.

Figure 4C:
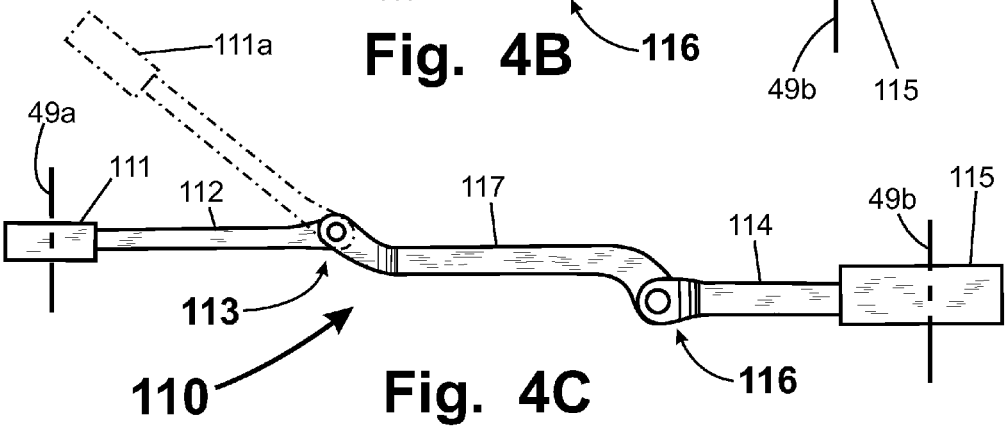

FIG. 4C Side view of tri-fold multiwrench 110 with largest wrench extended for use and arm fully extended for maximum torque.

Figure 5A:
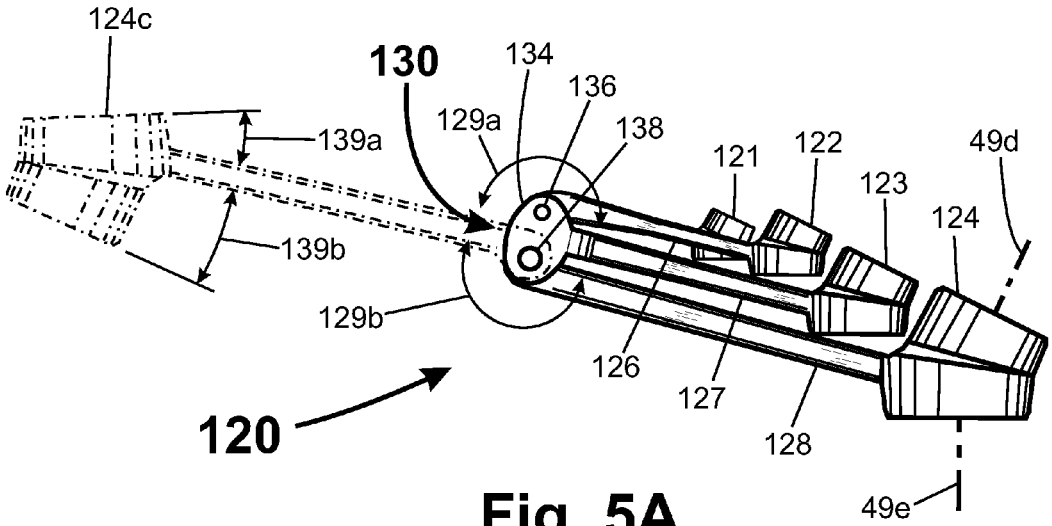

FIG. 5A Side view of multiwrench 120 with two substantially parallel hinges and four.

Figure 5B:
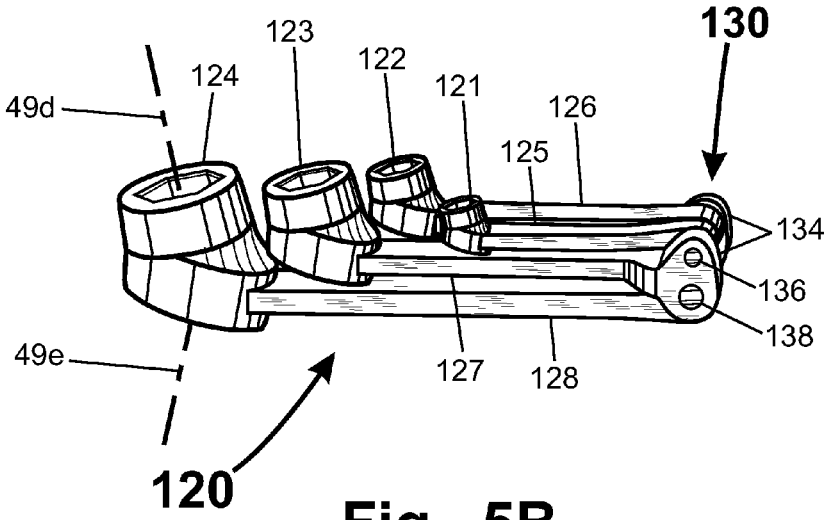

FIG. 5B Perspective view of the multiwrench 120 in FIG. 5A.

Figure 6A:
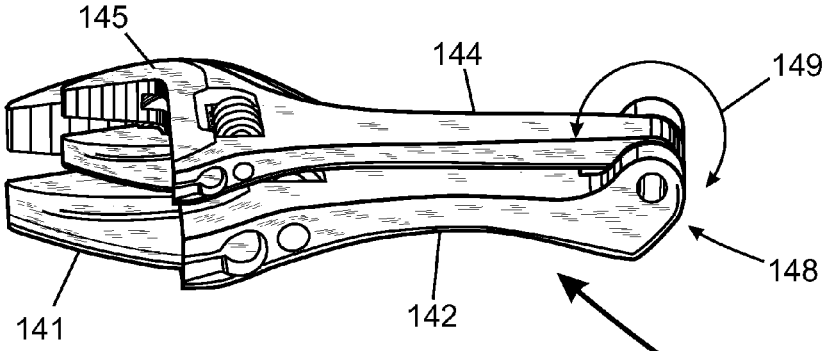

FIG. 6A Perspective view of multiwrench 140 with dual folding adjustable wrenches.

Figure 6B:
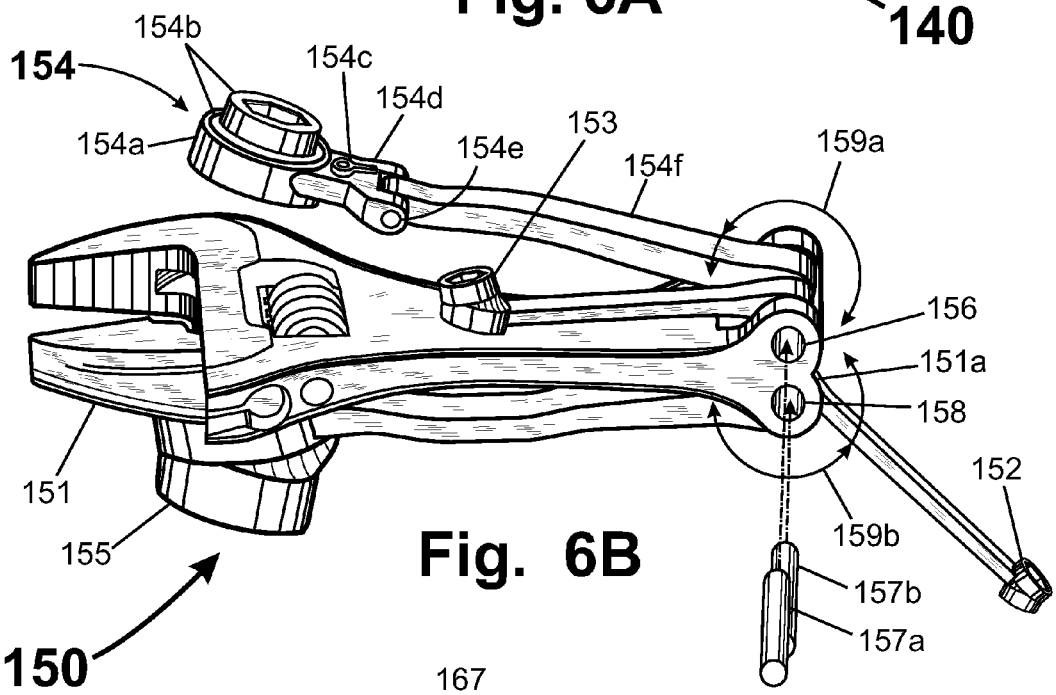

FIG. 6B Perspective view of multiwrench 150 with one adjustable wrench and four folding two-size duplex wrenches.

Figure 6C:
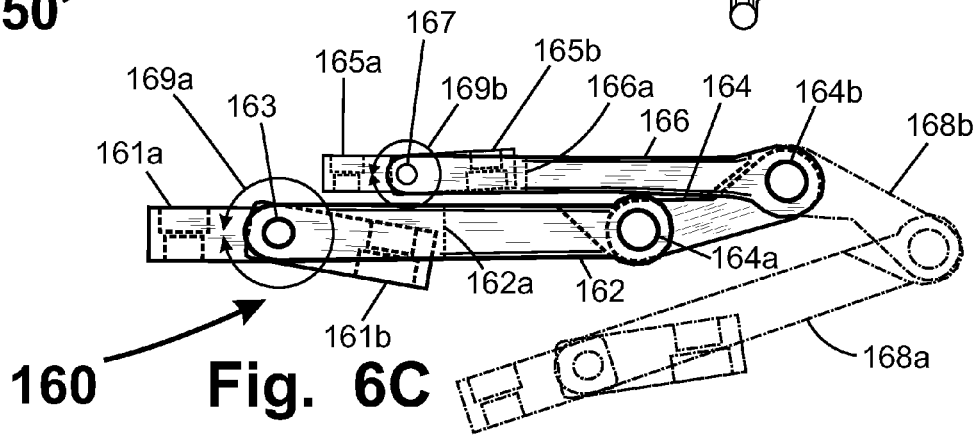

FIG. 6C Side view of multiwrench 160 with two folding hinge and two wrench head hinges.

Figure 7A:
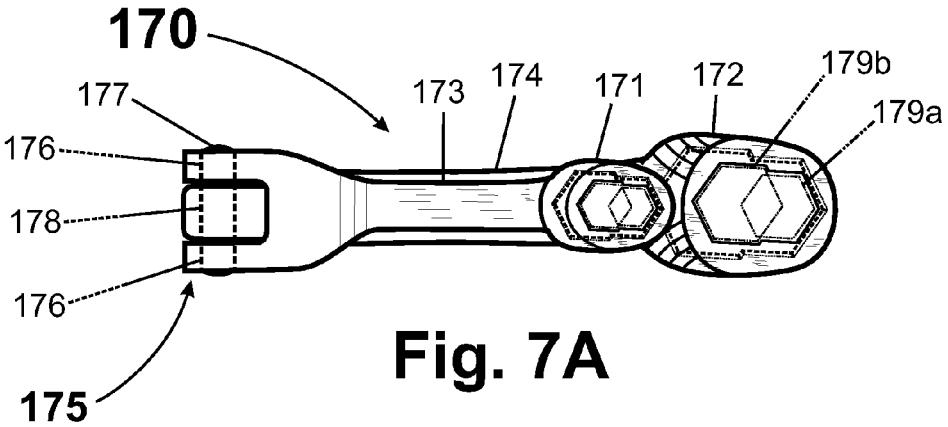

FIG. 7A Top view of multiwrench 170 with one hinge and two wrench arms each with a quad end head (overlapped duplex wrench head, 4-size quad head).

Figure 7B:
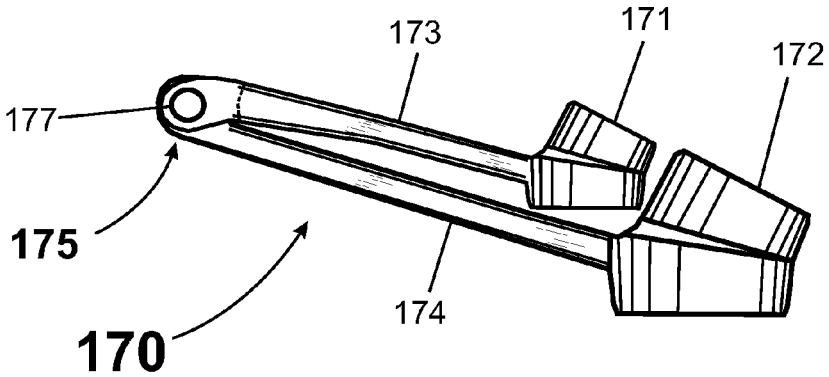

FIG. 7B Side view of multiwrench 170 showing the nesting of wrench heads 171 and 172, and arms 173 and 174.

Figure 7C:
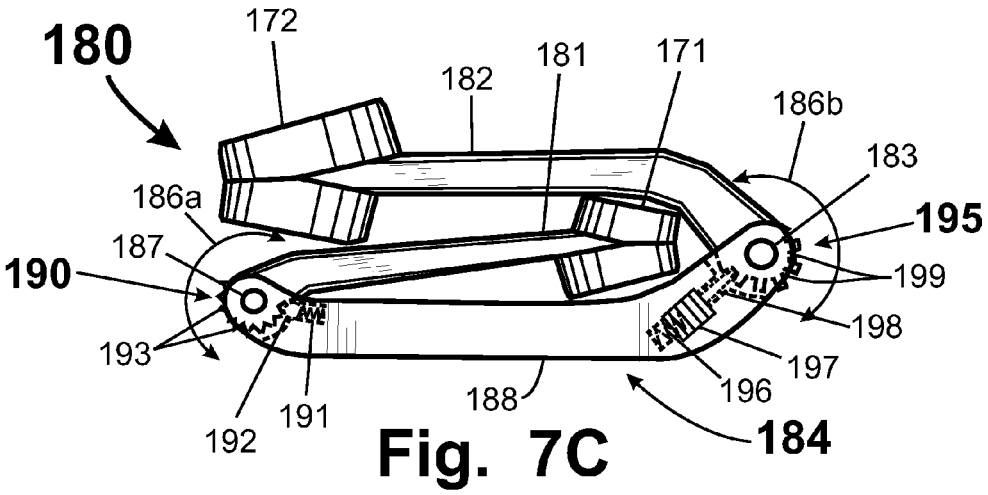

FIG. 7C Side view of multiwrench 180 showing a tri-fold wrench with two hinges, one center handle and two tool arms each supporting a four-sized wrench head.

Figure 8A:
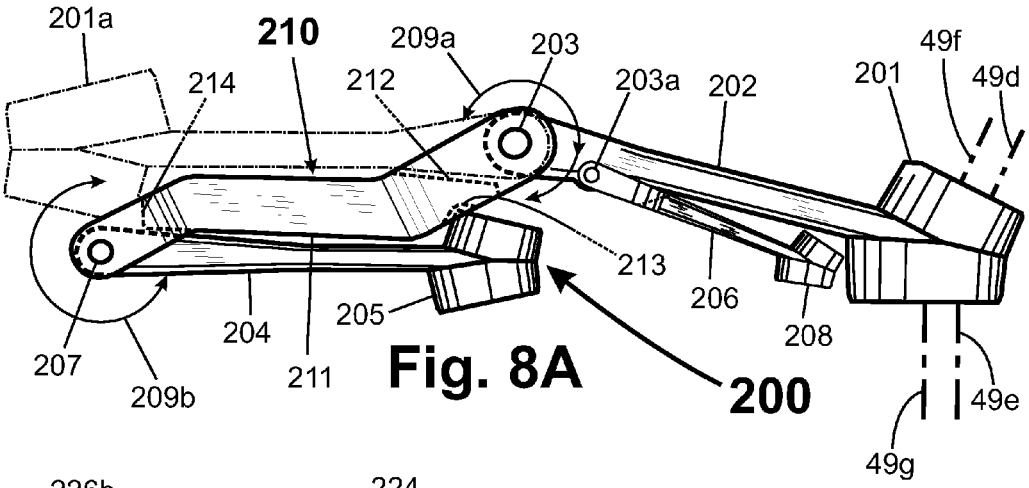

FIG. 8A Side view of multiwrench 200 showing a tri-fold wrench with two sided folding, two hinges, one center handle and two tool arms each with a quad wrench head.

Figure 8B:
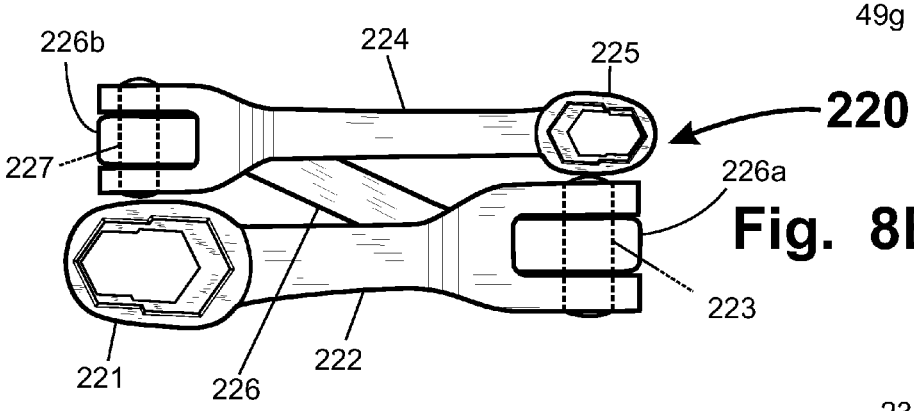

FIG. 8B Side view of multiwrench 220 showing a tri-fold wrench with wrench arms folding on the same side and angled center handle 226 to offset arms 222 and 224 to the side of each other. Two quad wrench heads used.

Figure 8C:
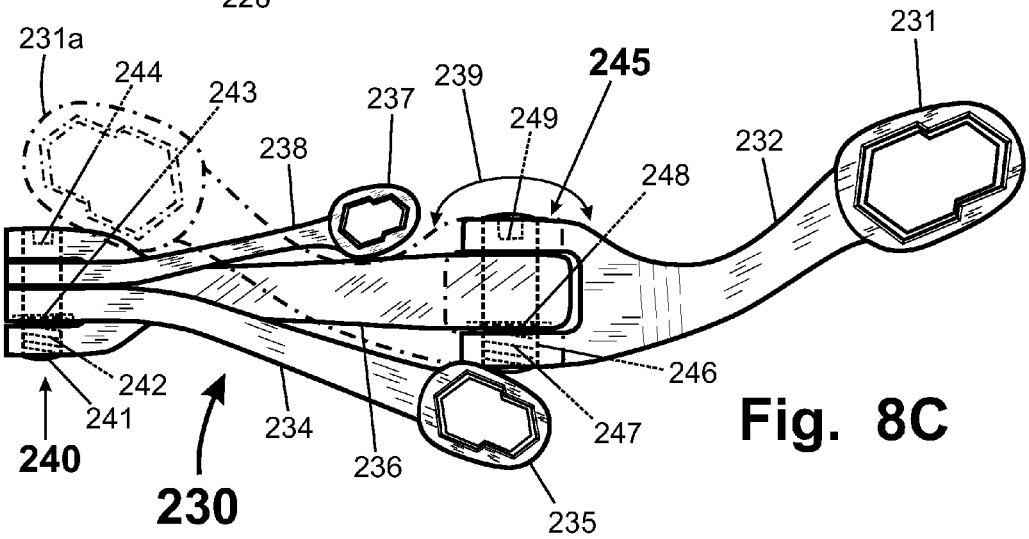

FIG. 8C Side view of multiwrench 230 showing a tri-fold wrench with wrench arms having a bend or angle so that they can be folded on side of the center handle when stowed. Three quad wrench heads are used.

Figure 9A:
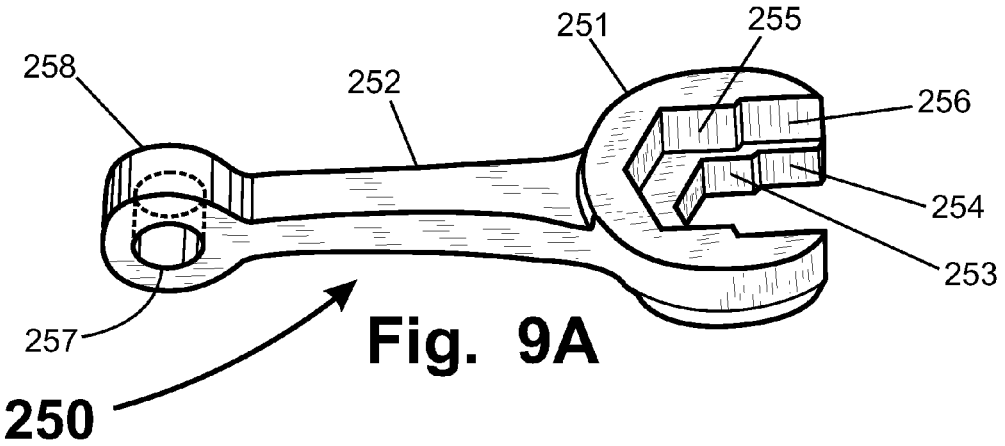

FIG. 9A Perspective view of quad head wrench 250 showing a four-size open-end overlapped duplex wrench.

Figure 9B:
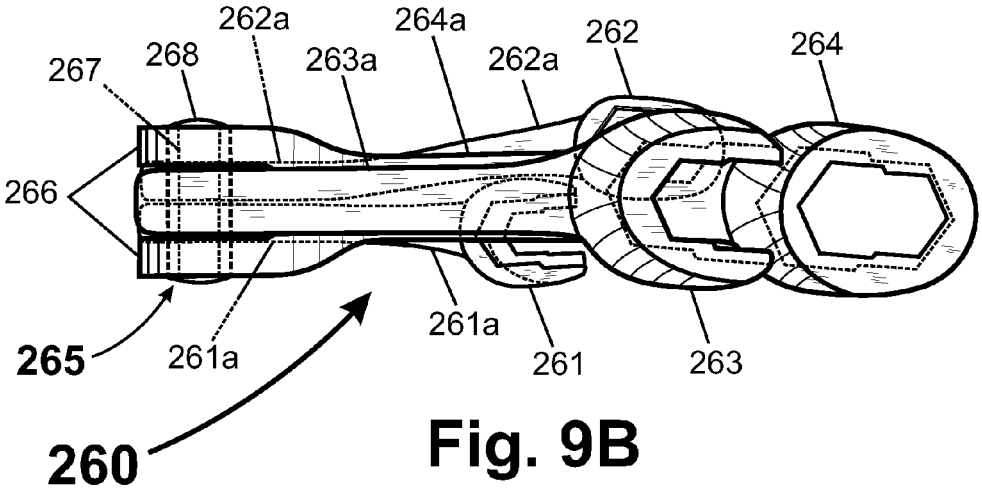

FIG. 9B Top view of multiwrench 260 with eight box-end & eight open-end wrench sizes.

Figure 9C:
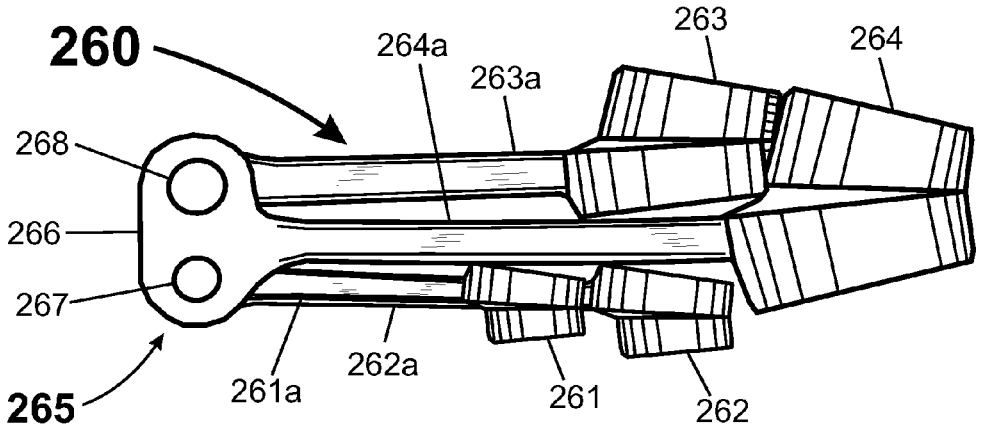

FIG. 9C Side view of multiwrench 260 with four quad wrench heads.

Figure 10A:
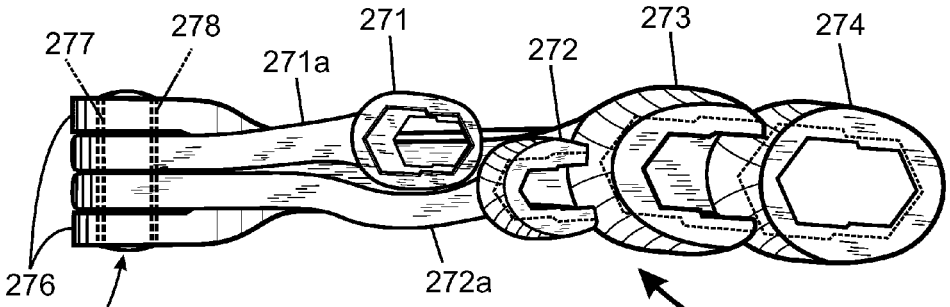

FIG. 10A Top view of multiwrench 270 with an alternate arrangement of four quad wrench heads comprising eight box-end sizes, and eight open-end wrench sizes.

Figure 10B:
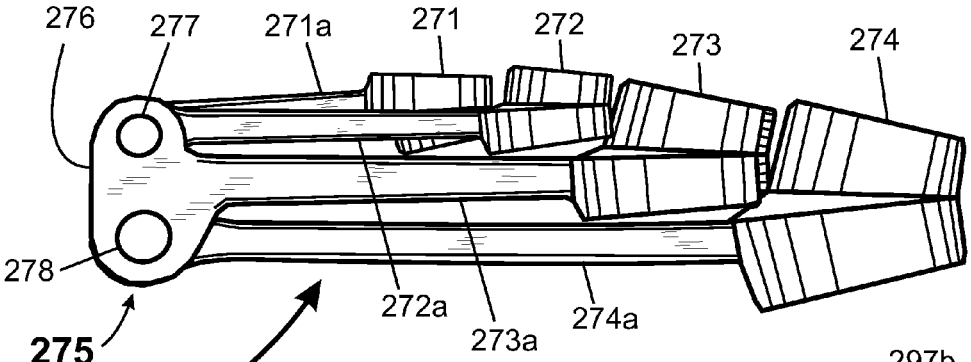

FIG. 10B Side view of multiwrench 270 with four quad wrench heads.

Figure 10D:
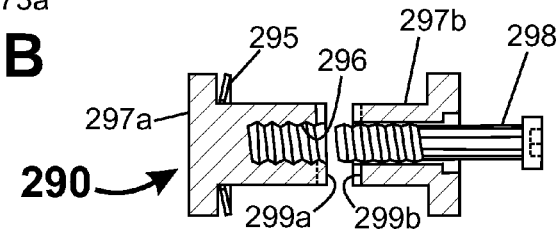
Figure 10C:
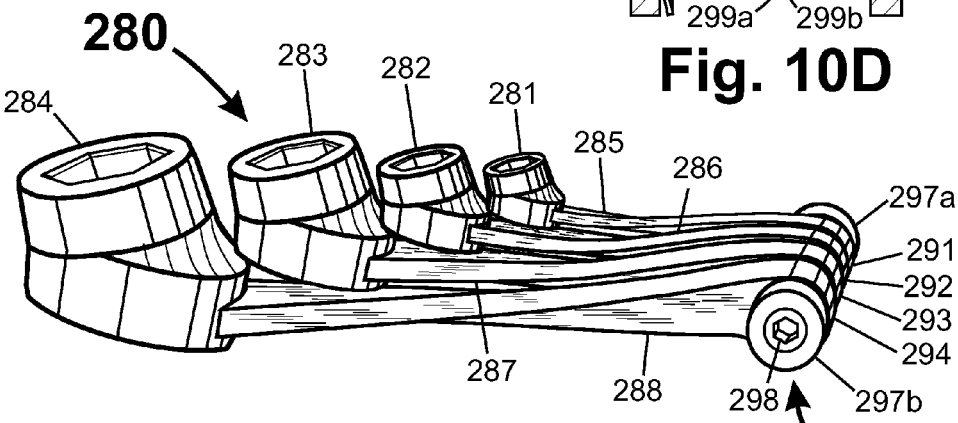

FIG. 10C Perspective view of multiwrench 280 with four duplexed wrench heads, and an alternative hinge. Further, the wrench arms are twisted ninety degree between the hinge and the wrench heads.

FIG. 10D Sectioned side-view of hinge assembly 290

DEFINITIONS

SUBSTANTIALLY PARALLEL—Less than thirty degrees (30°) of angle between two axes.

SUBSTANTIALLY PERPENDICULAR—Between sixty degrees (60°) and one-hundred twenty) (120° between two axes. Also two axis within plus or minus thirty degrees) (±30° from being perpendicular with each other axis.

WRENCH HEAD—Permanently attached gripping end of a wrench for turning a rotary fastener from the side of the gripping surface (wrench head is box end or open end). For duplexed wrench heads and other wrench head styles the axial height can be as much as three times the diameter of the largest gripping surface on that wrench head.

SOCKET or TOOL SOCKET—Detachable gripping portion designed to removably attach to a separate non-ratcheting wrench handle and/or a ratcheting wrench handle.

FOLDING HINGE—A hinge for pivotally connecting wrench arms and used to fold the multiwrench to less than approximately sixty-five percent its operational length.

PIVOT HINGE—A hinge positioned close to the wrench head and gripping surface to adjust the angle of the gripping surface(s) to various angles for use.

SUBSTANTIALLY PARALLEL AND ADJACENT (Lengthwise Adjacent)—Used to defines a stowed position for multiwrench arms. The longitudinal axes of the arms are substantially parallel when all the wrench arms are substantially parallel to each other. The wrench arms are substantially adjacent when each wrench arm is folded lengthwise adjacent one another as a group, and not necessarily when every wrench arm is directly adjacent every other individual wrench arm. Examples of parallel and adjacent multiwrenches arms are seen in FIGS. 2B-D, 3B-C, 4A, 5A-B, 6A & C, 7A-C, 8B, 9B-C, and 10A-C.

LONGITUDINAL AXIS OF A WRENCH ARM—An imaginary axis between the center of the arm's hinge axis and the center of that arm's wrench head or wrench head pivot axis if it has a pivot axis.

DETAILED DESCRIPTION OF THE INVENTION

All of the multiwrenches disclosed in this patent would generally be made of a hardened metal or metal alloy such as high carbon steel, chrome vanadium steel, stainless steel, titanium, aluminum, cobalt alloys, etc. The materials used to make the disclosed multiwrench are not limited to metals, and composite materials such as carbon fiber composites are also possible alternatives. The standard manufacturing methods of drop forging and machining can be used here to manufacture the disclosed multiwrench. Chrome vanadium steel is popular for wrenches like these because of its combination of relatively inexpensive cost, high strength, and good corrosion resistance. Standard wrench tool manufacturing techniques can be used to construct the disclosed wrenches. Hinge construction on these multiwrenches can comprise any hinge structure that can support the high torques that will be applied substantially perpendicular to the hinge axis during use. The hinge axis is oriented substantially perpendicular to rotary fastener's axis during use, so that the hinges do not need a locking mechanism in order for the user to transfer torque through the hinge to the rotary fastener. This means that when turning a vertical axis fastener the wrench hinge(s) are oriented substantially parallel to the horizontal plane normal to the fastener axis. A locking mechanism can be used to prevent pivoting of the hinges during use if desire and any of the multitude of hinge locking methods can be used.

Another way to think about this relationship of the axis of the folding hinge and the axis of the wrench head's gripping surface is to realize that as the wrench head is rotated around its gripping surface axis the folding hinge will be pivoted in either direction substantially parallel with its pivotal axis. This arrangement not only provides the ability to transfer torque from one end of the multiwrench to the other, but it also allows for a more vertically compact hinge arrangement. Because the hinge axis is substantially parallel to the direction a user naturally applies force to the extended arm to turn a fastener, the hinge resists pivoting because the torque applied is substantially perpendicular to the hinge axis. This tends to lock the hinge in place due to friction during use even thought the hinge can still be pivoted.

In the discussion of these multiwrench, the geometry of the wrench heads and hinges are critical Consider a vertical "rotary fastener" that has its rotational axis aligned with the vertical direction. This direction is also called the normal to a horizontal surface (or horizontal plane). We can use this horizontal surface discuss the multiwrench designs. For example, when I discuss the wrench head engaging a vertical rotary fastener, this will mean that the wrench head is gripping the surfaces of the rotary fastener and is aligned to rotate that fastener about its vertical axis. This orients the arm of that wrench head in a particular direction and also effects the orientation of the other wrench heads on the multiwrench. For many wrench designs this wrench arm is angle at fifteen degrees upward away from the horizontal surface. This angle allows room for the user's fingers between the wrench arm and the horizontal surface (which often involves a real surface) and makes the wrench much easier to use in tight places. Because each wrench head can have two or more wrench surfaces, the disclosed multiwrench heads can have many separate wrench tool axes (gripping surfaces) that are not aligned with each other (see FIG. 8A). Thus, each gripping surface on the wrench may have this fifteen degree angle if desired.

In FIGS. 1A-E we see three prior art multi-size wrench heads 20, 30 and 40 designed to provide more than one fixed wrench size. Many other prior art multi-sized wrench heads exist that are designed to grip two or more rotary fastener sizes, designed to grip a range of sizes, or are designed to be adjustable to multiple sizes. Each of these can be used with the disclosed folding multiwrench to provide a very ergonomic wrench system. Nearly all wrench styles and wrench types that exist in the prior art can be utilized by the disclosed folding wrench technology. The prior art presented in FIGS. 1A-E should be sufficient to allow someone skilled in wrench design to substitute other styles and types of wrench heads for the example ones shown here. Note that the multi-sized wrench heads shown in FIGS. 1A-E have a fixed number of distinct wrench sizes. This is not meant to limit the scope or types of wrenches that can be used with the folding multiwrench technology, but is instead meant to familiarize the reader with some multi-size wrench types they may not know about.

In FIGS. 1A-B, we see a sectioned perspective view of a six-point duplex box-end wrench head 20 with lobe style gripping surfaces. Arm 22 supports duplex wrench head 20 comprising a small six-point lobe box wrench gripping surface 24, a large six-point lobe box wrench gripping surface 26, and a divider 28 separating the small and large sizes. In FIG. 1B a side view of duplex wrench head 20 is seen attached to a two headed wrench with a smaller duplex box-end wrench head 25 attached to the opposite side of arm 22 and similar to wrench head 20 only smaller. Note that in this design wrench gripping surface axes 24*a* and 26*a* are angled at about fifteen degrees away from being perpendicular with the longitudinal axis 22*a* of wrench arm 22, which allows arm 22 to be angle at about fifteen degrees above a horizontal surface when turning a vertical axis rotary fastener with either of the wrench gripping surfaces 24 or 26. In alternative designs, it is common to have both gripping surface axes perpendicular to each other so that the tool head has a lower profile. The axial height 29*a* of wrench head 20 is basically its head clearance when turning a rotary fastener and can be measured form one side of the wrench head to the other along one of the wrench heads axes 24*a* or 26*a*. The axial height of the other wrench heads in this document can be measured in a similar manner. In FIG. 1B, bolt 27 (rotary fastener) is shown inserted in gripping surface 26 to show one example of a rotary fastener positioned for turning along the gripping surface's rotational or turning axis 26*a*.

In FIG. 1C we see top view of wrench head 30 attached to handle 32. Wrench head 30 comprises a small open-end lobe wrench gripping surface 34 and a large open-end lobe wrench surface 36. The lobe surfaces are overlapped to make a more compact two-size wrench head that can provide two distinct wrench sizes. In the prior art more than two distinct wrench sizes can be overlapped to give three or more distinct wrench sizes if desired.

In FIG. 1D-E we see a perspective views of quad wrench head 40 attached to handle 42. Wrench head 40 comprises two duplex wrench heads that have been overlapped to provide four distinct wrench gripping surface sizes. These four wrench sizes (quad wrench head) are defined by gripping surfaces 44*a*, 44*b*, 46*a*, and 46*b* from smallest to largest, and an optional separator ridge 48 is placed between wrench gripping surfaces 44*a-b* and wrench gripping surfaces 46*a-b* to help position the wrench on a rotary fastener during use. In FIG. 1D, wrench gripping surfaces 44*a-b* and 46*a-b* define tool axes that are shown with a slight angle from being perfectly flat (parallel turning axes), with the turning axis of wrench gripping surfaces 44*a-b* and 46*a-b* each angled slightly away from being perpendicular to the longitudinal axis of wrench handle 42. Alternatively, quad wrench head 40 can have wrench surfaces that are angled less or more than shown in FIGS. 1D-E. For example, wrench gripping surfaces 44*a-b* and 46*a-b* can be aligned so that their turning axes are perpendicular to wrench handle 42 to provide a substantially flat duplexed wrench head. Similarly, the axis of wrench gripping surfaces 44*a-b* and 46*a-b* can each be angled further away from handle 42 to make the wrench end more ergonomic for the user (see angle shown for gripping surfaces 24 and 26 in FIG. 1B). For the examples in this patent, the Applicant has used mostly duplex wrench heads with gripping surfaces that are angled approximately plus and minus fifteen degrees from perpendicular with the longitudinal axis of the wrench arms (handles), but other angles can be use including flat duplex wrenches. In FIG. 1E, we see a second smaller overlapped duplex wrench head 45 mounted on the other end of handle 42 to provide this wrench with eight distinct sizes from two quad wrench heads 40 and 45. The axial height 29*b* of wrench head 40 is shown and can be measured from one side of the wrench head to the other following the rotational axis of one of the gripping surfaces. The axial height 29*b* might be slightly larger if the angle of gripping surfaces 44*a-b* and 46*a-b* were increased to plus and minus fifteen degrees respectively.

In the FIGS. 2A through 4C, several variations for a folding multiwrench are shown in simplified form. These examples all have their wrench heads oriented with their gripping surface axis pointing vertically upward or downward (see rotary fastener axes 49*a-c*). The wrench heads in these figures are drawn as simply a box, where each boxes is meant to represent any of the low to medium profile wrench heads described earlier. Various wrench Styles, Types, and Gripping Surfaces can be used. Preferably at least some of the wrench heads are multi-sized wrench heads (multiple fixed sizes, adjustable, self-adjusting, etc.) to allow for more compact and ergonomic designs. For some of the most ergonomic designs, all the wrench heads can be either multi-sized and/or adjustable wrench heads. These multiwrenches can be made out of any strong material, such as high-carbon steel and chrome vanadium steel, which are the two most common materials used for wrenches today.

In FIG. 2A we see an assembly view of folding multiwrench 50 comprising a small wrench head 51, a small pivotal elongated wrench arm 52, a pivot hole 53, a pivot pin 57, a friction spring washer 57*a*, a large wrench head 55, a large pivotal elongated wrench arm 54, a pair of pivot holes 56 and a hinge paw 58. Assembly path 57*b* shows pivot pin 57 path through pivot paw holes 56, friction spring washer 57*a*, and pivot hole 53 on arm 52. Spring washer 57*a* is compressed between hinge paw 58 (pivot connector) and the end of wrench arm 52 to provide a consistent pressure on the contact surfaces (inside of paw 58 and outside of arm 52) to provide friction to resist pivoting. The result is a constant frictional resistance that allows smooth pivoting of arms 52 and 54 and also a holding force once positioned for use. Gripping surface axes 49*a-b* for wrench heads 51 and 55 respectively, are shown substantially perpendicular to both the longitudinal axis of their wrench arms 52 and 54, respectively, and the folding hinge axis 59*a*. The folding hinge comprises hinge paw end 58 with pivot holes 56, hinge post end on arm 52 with pivot holes 53, pivot pin 57, and friction washer 57*a*. In this particular design, folding hinge axis 59*a* is substantially perpendicular to both gripping surface axes 49*a-b* and wrench arm longitudinal axes 52*a* and 69*a*.

In FIG. 2A, longitudinal axis 52*a* is aligned with the body of wrench arm 52 and is oriented at a slightly different angle than longitudinal axis 69*a* which goes from the center of pivot hole 53 to the center of wrench head 51. Having the longitudinal axis through the two end to end of a particular wrench arm makes more sense when describing what direction the wrench arm points in rather than measuring the longitudinal direction of any particular portion (i.e. section where axis 52*a* is measured) of the wrench arm. For example, if longitudinal axis 52*a* were measured very near pivot hole 53, the apparent longitudinal axis at that point might point upward at a considerable angle and be quite different than the direction of axis 69*a*. Thus, for the purposes of this patent the longitudinal axis of a particular wrench arm or handle will be measured from the center of the arms pivot axis (e.g. center of hole 53) to the center of the wrench head (e.g. head 51) or center of a wrench head's pivot hinge if one exists (see pivot hinge 154*e* on arm 154*f* in FIG. 6B). This gives the best measure of the true direction a particular wrench arm is pointing. This particular one-hinge, two-arm design can take on many forms and specific examples of this arrangement are shown in FIGS. 6A, and 7A-B. Note that most designs in this patent can have additional arms added to the multiwrench. For example, additional arms can be added by expanding paw 58 and lengthening pivot pin 57 so additional wrench arms can be mounted on the hinge as needed in this design.

In FIG. 2B we see a side-view of wrench 50 assembled. Wrench 50 is shown here in its stowed position with arms 52 and 54 folded substantially parallel and adjacent each other. The rotational folding axis 59*a* for pivot pin 57 and holes 56 is substantially perpendicular to both tool head gripping surface axes 49*a* and 49*b* at all orientations of arms 52 and 54. This allows the arms to provide torque across the hinge. Arms 52 and 54 are permanently attached to wrench heads 51 and 55 in this example respectively, and can fold lengthwise adjacent each other as shown in FIG. 2B. Longitudinal axes 69*a-b* of wrench arms 52 and 54 respectively, are also substantially parallel to each other. Notice that longitudinal axes 69*a* and 69*b* are at a slight angle with respect to the body of arms 52 and 54 respectively. Both arms 52 and 54 can rotate about two hundred eighty degrees with respect to each other. If additional arms are added the angle of rotation can be reduced (see FIGS. 3B, 5A-B, 6B, 9B-C, and 10A-131. With either wrench arm 52 or 54 rotated approximately one-hundred-eighty degrees, the two arms can be substantially inline and can act like a single long wrench handle. For example, in FIG. 2B, if wrench head 51 and arm 52 are pivoted to the right, tool gripping surface axis 49*b* can be aligned with a rotary fastener so that tool head 55 grips that fastener and arm 52 and wrench head 51 can then be used as the handle for turning the fastener. Wrench heads 51 and 55 can be designed to fit multiple sizes of rotary fasteners, with either fixed or adjustable wrench heads (e.g. duplex wrench head, quad wrench head, crescent wrench heads, and etc.).

In FIG. 2C we see a side view of folding multiwrench 60 in one of its stowed positions. Wrench 60 comprises a small wrench head 61, a small elongated wrench arm 62, a large wrench head 65, a large elongated wrench arm 64, and a hinge assembly comprising a double hinge paw handle 66, and two pivot pins 67*a-b*. Small wrench head 61 can be permanently attached to arm 62 and is designed to pivotally connect to the hinge assembly at pivot pin 67*a*. Large wrench head 65 can be permanently attached to arm 64 and is designed to pivotally connect to the hinge assembly at pivot pin 67*b*. Double hinge paw 66 is "H" shaped with a center support 68 (center handle) being the horizontal support for the front and back sides of the hinge paw. Arms 62 and 64 can pivot around an arc of approximately two-hundred degrees as shown by the arrows. Because both arms can pivot around a single hub, they can be rotated together on the other side as shown by alternate positions 61*a* and 65*a*. This gives multiwrench 60 two stowed positions (i.e.

wrench head positions marked 61 and 65 and wrench head positions marked 61*a* and 65*a*), and also allows both sides of the wrench heads 61 and 65 to be used while stowed. This give this multiwrench 60 the ability to be used like a short handled wrench when folded as shown or as a long handle wrench when unfolded. By rotating the arms until they face in opposite directions a long handle is created for both wrench heads. Arm 62 can then be used to apply torque to wrench head 65, and arm 64 can be used to apply torque to wrench head 61. In both stowed positions (see FIG. 2C, first stowed position-solid lines, and second stowed position broken lines) wrench heads 61 and 65 are substantially lengthwise adjacent to each other and wrench arms 62 and 62 are fold substantially lengthwise adjacent one another. Both stowed positions fold the longitudinal axes 69*c-d* to a substantially parallel position with respect to each other. Thus, multiwrench 60 is shown with wrench arms that are substantially parallel and adjacent. Notice that arms 62 and 64 have an angled section 62*a* and 64*a*, respectively, that angles wrench heads 61 and 65, respectively about fifteen degrees from longitudinal axes 69*a-b* in the same direction. This small angle is optional, but can make the wrench heads easier to use and is commonly put on standard wrenches. If dual or quad wrench heads are used, both sides of the wrench head might be give a fifteen degree tilted surface and can have four or eight wrench sizes, respectively (see FIG. 7B). This particular two-hinge, two-arm, one hinge hub design has angled wrench heads which can have many forms. A specific example of this angled arrangement with quad wrench heads is shown in FIG. 6C where center handle 164 acts as the hinge hub and FIGS. 7A-B, where the hinge paw 66 has been replaced by a single hinge system like that seen on multiwrench 50 (seen in FIGS. 2A-B). Notice that gripping surface axes 49*a-b*, longitudinal arm axes 69*c-d*, and folding hinge pins 67*a* and 67*b* are all substantially perpendicular to each other, providing stable operation at all orientations of arms 62 and 64.

In FIG. 2D we see a side view of folding multiwrench 70 comprising a large high-profile wrench head 71, a large elongated wrench arm 72, a medium-profile wrench head 75, a small elongated wrench arm 74, and a hinge assembly comprising a hinge paw 78 on one end of arm 74, a pivotal hinge connector 73 (also called a hinge post) on the end of arm 72, and a pivot pin 77. Pivot pin 77 is generally fixed to hinge paw 78 (pivot connector) so that pivotal hinge connector 73 (hinge post) can pivot around pivot pin 77. The axis of rotation for arms 72 and 74 is shown by hinge axis 59*b* which is also the axis of pivot pin 77 once installed in hinge paw 78. Longitudinal axes 69*e* and 69*f* are nearly parallel with the body portions of arms 72 and 74, respectively. Notice that axes 69*e-f* are nearly horizontal because wrench heads 71 and 75 fold to one side of the other. A friction system is not shown in this design, but a friction washer like washer 57*a* seen in FIG. 2A is easily added to provide stable pivot angles for the wrench arms. This particular design has the hinge assembly mounted at a side offset angle 76 so that wrench head 71 pivots to a position adjacent wrench head 75 to the side when in the stowed position as shown in FIG. 2D. Angle 76 is slightly less than thirty degrees so that multiwrench 70 is shown with its wrench arms and heads substantially parallel and adjacent. This allows relatively high-profile wrench heads to fold down flat for fitting in a users pocket. In alternate designs, this angle 76 can be achieved by placing an angle in arms 72 and/or 74 (see angles in arms 232, 234 and 238 in FIG. 8C). A specific example of where this arrangement might be needed is if wrench heads 71 and 75 comprised Dog Bone® style wrench heads. This type of wrench head has a relatively high side-view profile compared to most wrenches. The ability of this design to allow Dog Bone® wrench heads to fold passed each other on the side can provide a more compact stowed position.

The reader should understand that each of the above examples (FIGS. 2A-D) can place more than one wrench arm on each hinge. There is no physical reasons which limit the number of arms per hinge, since additional support ribs can be added to the hinge paw as it gets wider to support the pivot pin and arms. However, five or six wrench arms per hinge is probably the maximum number of arms that this type of folding wrench system can effectively use (see multiwrench 280 in FIG. 10C) before the tool starts becoming cumbersome. Examples of more than two wrench arms on a single hinge can be seen in FIGS. 3A, 3B, 5A-B, 6B, 8C and 10C. The reader should also note that some of these hinge arms can hold other tools beside wrench heads. Screwdrivers, special sockets, pliers, etc. can be attached to some of the wrench arms if desired. For example, adjustable crescent wrench 151 (adjustable wrench head) on multiwrench 150 (see FIG. 6B), can be replaced with a screwdriver assembly if desired so that wrenches 152, 153, 154, and 155 can be folded to the right so their arms can be grasped together as the handle for the screwdriver assembly. In most cases only the center handle, that is attached to the hinge hub, can be used for such tools as a screwdriver because of the stability the hinge hub can provide. However, many other tools can be substituted on some of the wrench arms.

In FIG. 3A we see a side view of folding multiwrench 80 comprising three wrench heads 51, 81, and 85, three elongated wrench arms 52, 82, and 84, and a hinge assembly comprising pivot hole 53, compression spring washer 57*a*, pivot hinge hole 83, hinge paw 88, pivot pin 87 and a pair of pivot holes 86 for mounting pivot pin 87. Wrench arms 52, 82, and 84 are connected at one end to wrench heads 51, 81, and 85, respectively. Wrench arms 52 and 82 define pivot holes 53 and 83 (pivotal connectors), respectively, on their other end. One end of wrench arm 84 defines hinge paw 88 with its pair of mounting pivot holes 86. Pivot pin 87 follows assembly path 89 through the back side of pivot holes 86, through spring washer 57*a*, through pivot holes 53 and 83 and into the front side of pivot holes 86 to form the hinge assembly. Pivot pin 87 can be the pressed (deformed) to lock it in place against mounting pivot holes 86 as is common in the industry to pivotally attach wrench arms 52 and 82 to hinge paw 88 on the end of wrench arm 84. The other wrench arms in this patent can be similarly attached with a pivot pin like pivot pin 87. Alternatively, one of the holes 86 and one end of pivot pin 87 can be threaded so that pivot pin 87 can be screwed into place on hinge paw 88 as is also common in the tool industry. As in the other designs, spring washer 57*a* provides a large compressing force against the wrench paw and wrench arms to provide a consistent friction force for the arms. In this case the axial force provided by washer 57*a* also forces the end of wrench arm 52 against wrench arm 82 near hole 83, which is then pressed against the inside of hinge paw 88. Thus, a single compression spring washer can provide controlled friction for both arms 52 and 82. A heavier duty washer spring can be used to increase the friction force.

The wrench head axes 49*a*, 49*b*, and 49*c* are all oriented substantially perpendicular to the folding hinge axis 59*c*. Even when arms 52 and 82 are pivoted, the wrench head axes all remain substantially perpendicular to the hinge axis 59*c*. This allows each wrench arm to be used as a handle, with torque being able to transmit through the hinge because its axis is substantially perpendicular to the torque needed to turn a rotary fastener. The torque vector will be substantially parallel to the axis of the rotary fastener and wrench head axis being turned. Additional hinges can be mounted on hinge paw 88 (see FIGS. 5A-B and 6B) and/or arms 52, 82 and/or 84 (see FIG. 8A) to provide pivotal attachment points for additional smaller wrenches if desired.

In FIG. 3A, this particular one-hinge, three-arm design can take on many different configurations. A specific example of this arrangement can be seen in the upper portion of multiwrench 120 in FIGS. 5A-B, and the upper portion of multiwrench 150 in FIG. 6B. In the multiwrench 120 design hinge 138 has been added to hinge paw 88 to allow the attachment of additional wrench arm 128 and head 124. In the multiwrench 150 design, hinge 158 has been added to multiwrench design 80 to provide attachment of additional wrenches 152 and 155.

The hinge axis for all the above designs (FIGS. 2A-D, and 3A) lies along the longitudinal axis of their pivot pins (see axis 59*a* in FIG. 2A, axis 59*b* in FIG. 2D and axis 59*c* in FIG. 3A). These axes of rotation are designed to be substantially perpendicular to their wrench gripping surface axes 49*a*, 49*b*, and 49*c* at all usable orientations of the wrench arms. This perpendicular arrangement can be found in all the example pivotal wrench arms found in this patent. This arrangement allows the wrench arms to transfer torque from one wrench arm to another and ultimately to a wrench head on the other wrench arm without the hinge uncontrollably pivoting. The user's grip of the tool is sufficient to maintain the orientation of the arms. Generally, to achieve the best stability the hinge axis during use, the hinge axes should be within approximately ten degrees of perpendicular with the axis of their respective wrench gripping surfaces. Otherwise the hinge will tend to fold when the user attempts to turn a fastener. In alternate designs a locking mechanism can be used with the hinge to allow the user to fix the wrench arms in place without having to worry about the wrench arms pivoting. Because only small torques are produced around the folding hinges during use, a hinge locking system does not have to be very robust. This allows more options in selecting a locking system and many prior art locking systems can be used for the locking system (see locking system on hinge assembly 195 in FIG. 7C).

Similarly, each of the above folding wrench designs (FIGS. 2A-D, and 3A) are shown with longitudinal axes for their wrench arms 52, 54, 62, 64, 72, 74, 82 and 84 that is substantially perpendicular to both their wrench heads gripping surface axis and their pivot hinge axis. However, the longitudinal axes does not need to be substantially perpendicular to that wrench arms pivot hinge axis for normal operation. For example, if folding hinge axis 59*b*, seen in FIG. 2D, were angled further toward longitudinal axis 69*f* so that axis 59*b* was within sixty degrees of longitudinal axis 69*f* then axis 59*b* would no longer be substantially perpendicular to longitudinal axis 69*f* of arm 74. But hinge axis 59*b* can still be substantially perpendicular to gripping surface axis 49*b* so that torque can be easily transferred through the hinge and arm 72 could be further bent so that wrench head 71 folds adjacent the side of wrench head 75 for a compact stowed position. However, when wrench arm 72 is folded out the larger angle of hinge axis 59*b* will angle arm 72 with respect to arm 74 so that the arms form an angled wrench where the angle off the straight line orientation would be somewhere around sixty degrees or more depending on the exact bending of arms 72 and 74.

In FIG. 3B we see a side view of folding multiwrench 90 comprising four wrench heads 51, 81, 91, and 95, four elongated wrench arms 52, 82, 92, and 94, a wrench head pivot hinge 96, and a hinge assembly comprising a small folding hinge 93, a large folding hinge 97, and a hinge housing 98 (hinge connector end of arm 92). Wrench heads 51 and 81 are attached to arms 52 and 82 respectively, and can also be seen in FIG. 3A in perspective view (multiwrench 80). Wrench head 95 and wrench arm 94 can have a construction similar to wrench head 85 and wrench arm 84 seen in FIG. 3A, but includes a pivot hinge 96 connecting wrench head 95 to wrench arm 94 and to allowing wrench head 95 to pivot to various angles for use. Hinge housing 98 is shown with a split paw attachment on the top for hinge 93, and a post style attachment for hinge 97 on the bottom. The paw spacing for hinge 93 is sufficient to attach both wrench arms 52 and 82 within hinge 93. The two smaller wrench arms 52 and 82 are placed close together on purpose to keep the width of hinge 93 approximately the same as the width of hinge 97 for a balanced look to multiwrench 90. Both wrench arms 52 and 82 have the same pivotal range of motion 99 which can be more than one-hundred eighty degrees, but will be often limited to approximately one-hundred eighty degrees so that when arms 52, 82, and 94 are pivoted to the right in FIG. 3B, they form a very stable handle for the user to grip and use to turn large wrench head 91. Wrench head 91 and arm 92 can be integral with hinge housing 98 and all three components can be drop forged as a single piece. In alternative designs, this hinge housing 98 can be a separate part that is welded or otherwise attached to arm 92. Hinge housing 98 in this design is arranged to allow the pivotal wrench arms 52, 82, and 92 to rotate to approximately one-hundred eighty degrees or more so that each of these arms and their associated wrench heads can be rotated out individually for use. The wrench arms can be rotated to other angles besides one-hundred eighty degrees. For example, wrench head 81 and wrench arm 82 are shown in an alternate position at 81*a* and 82*a*, respectively. With all the pivotal arms 52, 82, and 94 rotated to the right side of hinge housing 98, wrench head 91 remains by itself on the left for use and the other three wrenches acting as the handle.

In FIG. 3B, hinge 96 can be a standard wrench hinge that is placed very near large wrench head 95. The placement of a hinge near the wrench head is a common practice and each of the other three wrench heads 51, 81, and 91 can comprise a similar wrench head hinge if desired. In this example, only wrench head 95 is shown with a hinge to keep the drawing from being cluttered. Hinge 96 adds versatility to the multiwrench by allowing nearly any angle for wrench head 95. Also, because of this ability to angle the wrench head, duplexed and quad wrench heads do not need to have the fifteen degree angle built in as seen in many of the other examples in this patent. Instead the wrench heads can be made flat (wrench gripping surface axes parallel to each other) like wrench heads 161*a-b*, and 165*a-b* seen in FIG. 6C, to provide a thinner (lower profile) wrench heads while at the same time allowing a multitude of operating angles, not just fifteen degrees. The down side of using wrench head hinges like hinge 96 is that it makes the tool more complicated and expensive, and can also make the tool more difficult to use if insufficient friction is built into the hinge so that wrench head 95 just flops around during use.

In FIG. 3B, multiwrench 90 can have many configurations of its two-hinges and four wrench arms with many different types of wrenches and/or additional wrenches. A specific example of this arrangement can be seen in FIGS. 10A-B except double hinge paw housing 276 (hinge connector) has two paws hinge mounts instead of one paw mount and one post mount. Multi wrench 260 seen in FIGS. 9B-C, also has similar construction, but the longest arm is attached to the hinge paw 266 (hinge connector) instead of the second largest to show how the wrench heads can have multiple arrangements. Another example of this arrangement can be seen in FIGS. 5A-B except the length of the wrench arms have been adjusted to fit more compactly with the shown wrench heads. The design seen in FIGS. 5A-B has different length arms and no wrench hinge, but the general construction is nearly the same. Also, multiwrench 150 seen in FIG. 6B has similar structure, but with an extra wrench 152 added to the bottom hinge. In FIG. 3B, hinge housing 98 has a paw style end for the top hinge 93 and a post style pivotal end for bottom hinge 97. Thus, this basic example of multiwrench 90 can be configured in many styles and configuration and hinge housing 98 can easily be replaced by other hinge styles (i.e. have two paw style ends, or have two post style ends with appropriately matching arms). All the dual hinge housings disclosed in this document can use any of these configurations.

In FIG. 3C we see a side view of folding multiwrench 100 comprising three wrench heads 101, 102, and 103, three elongated wrench arms 104, 105, and 106, and a hinge assembly comprising a hinge housing 108 and two hinges 107 and 109. Arms 104, 105, and 106 can be permanently attached to wrench heads 101, 102, and 103, respectively. Arm 104 is pivotally attaches to hinge 107, arm 105 is attached to hinge housing 108, and arm 106 is pivotally attached to hinge 109. The wrench head 101 and wrench arm 104 can be forged as a single piece of steel or composed of individual parts bonded together. Similarly, wrench head 103 and wrench arm 106 can be forged from a single piece of steel or composed of individual parts. Finally, wrench head 102, wrench arm 105, and hinge housing 108 can be made from a single piece of metal or composed of multiple parts bonded together. In this design, when folded in its stowed position shown in FIG. 3C, wrench heads 101, 102 and 103 are nested with each wrench arm 104, 105, and 106 being longer than one before it. The nesting of the wrench heads can provide a more compact stowed configuration, especially if the arms are attached on one edge of the wrench heads (wrench arm 106 attached at the bottom of wrench head 103). By doing this, the profile height of the wrench heads can fit substantially within the height of the next largest wrench (see side view of multiwrench 120 in FIG. 5A) where the top surface of the wrench heads are nearly in the same plane.

In FIG. 3C, this particular two-hinge, three-arm design can have many forms and a specific example of this type of nested arrangement can be seen in multiwrench 120 in FIGS. 5A-B. Multiwrench 120 also includes a fourth wrench head 121 and arm 125 which are nested to the side of arm 126 to provide more functionality. Note that if the arms were attached near the middle of the wrench heads, the overall height of the wrench in its stowed position would be much greater because the wrench heads would force the arms further apart.

In FIGS. 4A-C, we see tri-fold multiwrench 110, comprising a pair of folding hinges 113 and 116, a small wrench comprising an elongated wrench arm 112 and wrench head 111, a large wrench comprising an elongated wrench arm 114 and wrench head 115, and a elongated center handle 117. The hinges 113 and 116 can comprise compression spring washers (hidden in these drawings, see hinge washer 57*a* in FIG. 3A) to provide friction for the pivoting arms. Along with the spring washer, hinges 113 and 116 can comprise locking hinges (not shown in this drawing, see hinge 195 in FIG. 7C) to allow the wrench to be pivoted to a particular angle and then locked into that position. Wrench arms 112 and 114 can pivot through a range shown by arrows 119*a* and 119*b*, respectively. This would allow the user to apply press on the wrench in ways that would normally pivot a non-locking friction hinge. Hinge 113 pivotally connects arm 112 to the small end of center handle 117. Hinge 116 pivotally connects arm 114 to the large end of handle 117. Handle 117 is slightly "S" shaped so that arms 112 and 114 can be substantially straight to allow wrench heads 111 and 115 to lay flat against center handle 117 when stowed as shown in FIG. 4A.

The construction of the wrench heads, arms and hinges can all be similar to the other wrench examples discussed in this patent. Arms 114 and 112 can be shorter than in the previously discussed designs because the length of center handle 117 adds to the overall length of the wrench when fully extended. To maximize compactness of multiwrench 110, wrench arms 112 and 114 including their wrench heads 111 and 115 respectively, should be near the same length as center handle 117, as shown in FIG. 4A. Because wrench arms 112 and 114 are shorter it is easier for wrench heads 111 and 115 to get into tighter places. Because of this, wrench heads 111 and 115 can be constructed without angled gripping surfaces (see angled wrench gripping surface axes 49*d* and 49*e* in FIG. 5A) and handle 117 can still angle away for a surface near the rotary fastener so that the wrench provides space for the user's hand (see FIG. 4B-C).

In FIG. 4A, multiwrench 110 is shown in its stowed position with arms 112 and 114 folded lengthwise adjacent center handle 117. This provides a compact wrench that can be shorter than the single fold wrenches seen in FIGS. 2A through 3C but still extend to full length (see FIG. 4C). This particular two-hinge, two-arm, one center handle design can take on many forms and two specific examples of this type of tri-fold arrangement can be seen in multiwrench 200 in FIG. 8A. Also, multiwrench 220 seen in FIG. 8B and multiwrench 230 seen in FIG. 8C can be an example multiwrench 110 if the wrench arms were designed to fold on the opposite side of their respective center handle.

In FIG. 4B we see a side view of folding multiwrench 110, where arm 112 and wrench head 111 pivoted against center handle 117 in the short handle position for turning wrench head 115. In this position, the multiwrench is approximately two-thirds (⅔) of its fully extended length for turning rotary fasteners with wrench head 115. If both wrench arms 112 and 114 are pivoted one-hundred eighty degrees from this position, arm 114 and wrench head 115 will be against center handle 117 in the short handle position for turning wrench head 111 on arm 112.

In FIG. 4C we see a side view of folding multiwrench 110, with both arms 112 and 114 rotated to their extended position. In this position both wrench heads 111 and 115 can be used to provide maximum torque by gripping the extended end of the opposite wrench arm. A vertical axis torque placed on one wrench arm can be transferred through the two hinges to the opposite wrench head to turn a rotary fastener (bolt, nut, screw, etc.). For example, by applying a force to arm 112 and wrench head 111, a torque can be transferred through hinge 113, into center handle 117, through hinge 116, into arm 114 and finally into wrench head 115 for turning a bolt (rotary fastener). Arm 112 can be positioned as shown, or angled at alternate position 111*a*, or any of a number of other angles to achieve this. Similarly, center handle 117 can be angled in multiple ways to user preference. Thus many configurations of center handle 117 and wrench arms 112 and 114 are possible.

In FIGS. 5A and 5B, we see folding multiwrench 120 comprising four duplex box-end wrench heads 121, 122, 123, and 124, four elongated wrench arms 125, 126, 127, and 128, and a hinge assembly comprising hinge housing 134 (hinge connector), small folding hinge 136, and large folding hinge 138. Wrench heads 121, 122, 123, and 124 are attached to the four wrench arms 125, 126, 127, and 128, respectively. Arms 125, 126, and 128 are designed with a post style hinge portion, while wrench arm 125 is attached to a double hinge paw style housing 134. Each of these hinges 136 and 138 can be of standard design with a pivot pin fixed across the hinge housing 134 to pivotally attach wrench arms 125, 126, 127, and 128. Arms 125 and 126 are pivotally connected to hinge 136, and arm 128 is pivotally connected to hinge 138. All three of these pivotal arms 125, 126, and 128 can pivot through a range of approximately one-hundred and eighty degrees or more as shown by pivot range arrows 129*a-b*. In FIGS. 5A and 5B foldable multiwrench 120 is shown in its stowed position with elongated wrench arms 125, 126, and 127 substantially lengthwise adjacent to elongated wrench arm 127.

In FIGS. 5A-B, we see wrench heads 121, 122, 123, and 124 each comprising two wrench head sizes in a duplex format. Each size faces in substantially opposite directions so each side of the wrenches provides a different wrench size. FIG. 5B shows multiwrench 120 at approximately actual size for standard wrench sizes 11/16", 5/8", 9/16", 1/2", 7/16", 3/8", 5/16", and 1/4". Looking at wrench head 124 with sizes 11/16" and 5/8", as an example, we see that wrench head 124 has two wrench gripping surface axes 49*d* and 49*e*, which are each inline with the axis of its respective wrench gripping surface to turn a rotary fastener. In this design, these two wrench sizes have axes that are each angled approximately fifteen degrees away from perpendicular with the longitudinal axis of wrench arm 128. This slight tilt improves the ergonomics of the wrench head by making it easier for the user to align the wrench properly with the rotary fastener. The tilting of the wrench head gripping surfaces is also seen in the off-set angles 139*a-b* of the wrench head faces. While it is common for off-set angles 139*a-b* to be anywhere from zero to ninety degrees, depending on the use of the wrench, most wrenches have a wrench face angle between zero to thirty degrees, with zero and fifteen degrees being the two most common angles. Each of the other wrench heads 121, 122, and 123 have similar construction, but have different wrench sizes.

In FIGS. 5A and 5B, we see folding multiwrench 120 comprising four duplex box-end wrench heads 121, 122, 123, and 124, four elongated wrench arms 125, 126, 127, and 128, and a hinge assembly comprising hinge housing 134 (hinge connector), small folding hinge 136, and large folding hinge 138. Wrench heads 121, 122, 123, and 124 are attached to the four wrench arms 125, 126, 127, and 128, respectively. Arms 125, 126, and 128 are designed with a post style hinge portion, while wrench arm 125 is attached to a double hinge paw style housing 134. Each of these hinges 136 and 138 can be of standard design with a pivot pin fixed across the hinge housing 134 to pivotally attach wrench arms 125, 126, 127, and 128. Arms 125 and 126 are pivotally connected to hinge 136, and arm 128 is pivotally connected to hinge 138. All three of these pivotal arms 125, 126, and 128 can pivot through a range of approximately one-hundred and eighty degrees or more as shown by pivot range arrows 129*a-b*. In FIGS. 5A and 5B foldable multiwrench 120 is shown in its stowed position with elongated wrench arms 125, 126, and 128 substantially lengthwise adjacent to elongated wrench arm 127.

In FIG. 6A, we see a perspective view of folding multiwrench 140 comprising a small adjustable wrench head 145 (adjustable wrench head), a small elongated wrench arm 144, a large adjustable wrench head 141, a large elongated wrench arm 142, and a folding hinge 148. Wrench heads 141 and 145 are Crescent style wrenches, but other adjustable style wrenches can easily be substituted. Wrench heads 141 and 145 are attached to wrench arms 142 and 144, respectively. Both wrench arms 142 and 144 are pivotally connected at hinge 148 which can comprise nearly any standard hinge design (standard paw and post design shown). Wrench arm 144 has a pivot range shown by arrows 149. As with other folding multiwrench sets presented in this patent, different sized wrenches are chosen to provide the user with the ability to get to the largest number of rotational fasteners as possible. Thus, when a larger wrench will not fit into the space around a fastener, the smaller wrench head becomes very important because it can reach into that tighter space. Also the smaller wrench head makes it easier for the user to grip smaller fasteners. Thus, having a second adjustable wrench head size makes the tool more versatile while at the same time providing an extended handle for the other wrench head.

In FIG. 6B, we see a perspective view of folding multiwrench 150 comprising an adjustable wrench 151, a small duplex box-end wrench 152, a medium duplex box-end wrench 153, a large reversible ratchet duplex box-end wrench 154, an extra large duplex box-end wrench 155, a top folding hinge 156, a bottom folding hinge 158, and two pivot pins 157*a-b*. Adjustable wrench 151 defines an double hinge paw 151*a* on rear portion of its handle for mounting folding hinges 156 and 158. Pivot pins 157*a* and 157*b* are mounted into hinges 156 and 158, respectively, to provide a pivotal axis for each hinge. Each duplex wrench 152, 153, 154, and 155 define an elongated arm and a wrench head with two distinct wrench sizes each, which combine to give the user a complete eight-size box-end wrench set. The addition of adjustable wrench 151 completes the compact folding multiwrench for the user. Duplex box-end wrenches 153 and 154 are each pivotally connected to hinge 156 by pin 157*a*. Duplex box-end wrenches 152, and 155, are each pivotally connected to hinge 158 by pin 157*b*. Both hinges 156 and 158 can allow their respective wrenches to pivot more than one-hundred eighty degrees as shown by range of motion arrows 159*a-b*, though not all at the same time. Wrenches 152, 153, 154, and 155 can fold against adjustable wrench 151 for a stowed position. Wrenches 152, 153, 154, and 155 can be contoured during manufacturing to the adjustable wrench's surface features to provide a compact stowed position. Similarly, wrenches 152, 153, 154, and 155 can be contoured during manufacturing so that when they are all folded together to the right of adjustable wrench 151, with their shapes fitting together to form an ergonomic handle for wrench 151. In this way, each wrench can be use with an ergonomic handle comprised of the other four wrenches (wrench arms and wrench heads).

In FIG. 6B, we see wrench 154 comprising a ratchet housing 154*a*, a ratchet hub 154*b* (also called a ratchet head or ratchet wheel), a selectable ratchet mechanism 154*c*, a wrench head arm 154*d*, a wrench head hinge 154*e*, and a wrench arm 154*f*. Ratchet housing 154*a* is mounted on arm 154*d* with ratchet mechanism 154*c* mounted within arm 154*d* to allow reversible ratchet motion of ratchet hub 154*b*. Ratchet hub 154*b* defines a flat duplex wrench pair that may or may not have their axes perfectly aligned. Ratchet mechanism 154*c* allows ratchet action of hub 154*b* in either direction within housing 154*a* depending on the position selected for mechanism 154*c*. Wrench head ratchet mechanisms like mechanism 154*c* are common, and many different ratchet mechanisms exist in the prior art which can be used for mechanism 154*c* with many variations possible. Hinge 154*e* pivotally connects wrench arm 154*f* to wrench head arm 154*d*. Wrench head arm 154*d* is kept short to allow easier positioning of the wrench head. An alternative for hinge 154*e* is to place the paw portion of hinge 154*e* on arm 154*f* and the post portion on arm 154*d* to reduce the size and length of the wrench head. This combination of housing 154*a*, hub 154*b*, ratchet mechanism 154*c*, and wrench head arm 154*d* can pivot on hinge 154*e* to allow the wrench head to be angled as needed to get to specific rotary fasteners with both sides of the wrench. Hinge 154*e* can include a friction system and/or locking system if desired (see FIGS. 3A and 7C, respectively) to maintain a particular angle for wrench head arm 154*d* during use. In alternative designs, box wrenches 152, 153, 154, and 155 can be made shorter and/or fold to the side of adjustable wrench 151 so that wrench 151 can still be used with the other wrenches folded in their stowed position next to wrench 151. Also, alternatively, additional wrenches can be added to hinges 156 and 158 if desire. This is especially easily to do if smaller wrench sizes are added since smaller wrenches will have smaller forces on them, so their handle can be made relatively narrow compared with the other wrenches. Thus, the hinges for these smaller wrenches do not have to add much width to hinges 156 and 158 on multiwrench 150.

In FIG. 6C, we see a perspective view of folding multiwrench 160 comprising a small Figure-8® style wrench head that comprises two duplex wrench heads 165*a-b* pivotally mounted to wrench head hinge 167, a large Figure-8® style wrench end that comprises two duplex wrench heads 161*a-b* pivotally mounded to wrench head hinge 163, a large elongated wrench arm 162, a small elongated wrench arm 166, a center handle 164 and two folding hinges 164*a-b*. Wrench arm 162 defines a elongated hinge paw slot 162*a* for supporting hinge 163 and wrench heads 161*a-b*. Wrench arm 166 defines an elongated hinge paw slot 166*a* for supporting hinge 167 and wrench heads 165*a-b*. In this design, wrench heads 161*a-b* and 165*a-b* can pivot three-hundred sixty degrees (see arrows 169*a-b*) around their respective hinges 163 and 167 in hinge paw slots 162*a* and 166*a*, respectively, as is typical for the Figure-8® design. Hinges 164*a-b* allow multiwrench 160 to fold approximately in half, but center handle 164 allows this folding to be offset in either direction (see position 168*b*). The design shown in FIG. 6C shows arm 162 extending beyond arm 166 because of the position of center handle 164. In alternatively designs center handle 164 can be eliminated and arms 162 and 166 can be pivotally attached together at their hinge ends. Each wrench head 161*a-b* and 165*a-b* can be rotated between an extended position for use (see wrench heads 161*a* and 165*a*), and a retracted position where it is rotated into its respective hinge paw slots 162*a* and 166*a* (see position of wrench heads 161*b* and 165*b*). This arrangement allows the wrench heads to be made relatively short so that the wrench heads can get into tight places by rotating it to any angle as needed. Wrench head hinges 163 and 167, and folding hinges 164*a* and 164*b* can all be provided with a friction system and/or locking system, such as using spring washer 57*a* discussed previously, to provide the multiwrench with smooth secure motion and the ability to hold a particular position during use.

In FIG. 6C, center handle 164 is pivotally connected to wrench arm 162 by hinge 164*a*, and also pivotally connected to wrench arm 166 by hinge 164*b*. This arrangement allows the two arms to fold together for compact storage, and rotate to an extend position to operate as a long handled wrench. In the fully extended wrench position, where arms 162 and 166 are rotated substantially inline with themselves and center handle 164, maximum torque can be applied by the multiwrench. Multiwrench 160 also has a short handle mode where each of the wrench heads can be used while folded in one of two stowed positions. For example, in FIG. 6C multiwrench 160 is shown folded in a first stowed position, where wrench heads 161*a-b* can extended beyond the smaller wrench heads 165*a-b* so that they can be used effectively in this "short handle" configuration (wrench arms substantially folded together). In this position wrench heads 161*a-b* can rotate to many usable positions. Similarly, if center handle 164 and arm 162 are rotated to positions 168*b* and 168*a*, respectively, arm 162 can then be fold against arm 166 for a second storage position. FIG. 6C does not show this second stowed position directly because showing this second position creates a mess of lines for this drawing. In this second stowed position the smaller wrench heads 161*a* and 161*b* can be used by rotating them out for use, while arms 162 and 166 act as a short handle for the multiwrench. Multiwrench 60 seen in FIG. 2C also can pivot to more than one stowed position. Because the axis of each folding hinge 164*a-b* and each wrench head hinge 163 and 167 are substantially perpendicular to the axis of the wrenches turning surfaces (or gripping surfaces, also the rotational axis of the rotary fastener being tightened or loosened), torque can be transferred through all the hinges and to a rotary fastener with minimal friction needed to hold the hinges in place during use. In alternative designs folding hinges 164*a-b* can have a locking mechanism to hold the multiwrench in a particular arrangement until the user decides to change it.

In the previous discussion of FIGS. 5A-B and 6B-C, we saw folding wrench examples which use duplex wrench heads to provide two distinct sizes per wrench head. While these dual-sized wrench heads provide an ergonomic use of space, there are many other designs that combine multiple wrench sizes. For example, each duplex wrench head seen in FIGS. 5A through 6C can be replaced with dual-size overlapped wrench heads (see quad wrench head 40 in FIG. 1C). To give the reader further examples of the many ways multi-sized wrenches can be combined into a folding wrench, FIGS. 7A through 10B, show a number of examples for the folding multiwrench where the quad head design is used (see FIGS. 1D-E). This use of four sizes per wrench head allows for twice as many wrench sizes as the duplex or dual overlap wrench heads for the same number of wrench arms. These quad wrench heads can allow many different configurations. For example, FIGS. 9B-C and 10A-B show two different ways eight box-end wrench sizes and eight open-end wrench sizes can be combined into one multiwrench. Alternatively, these same wrench arm configurations can comprise eight metric wrench sizes and eight standard SAE sizes, with box-end, open-end wrenches, or a combination of both types of ends if desired. (i.e. eight metric box-ends and eight SAE open-end, etc.). Finally, both box-end and open-end wrenches have several surface styles and shaped that further increase the number of combinations that are possible. Thus, the reader should understand that many ergonomic ways exist for combining various multiple size wrench heads with various arm and hinge configurations, and only a few of these combinations are represented in the examples in this patent. However, someone skilled in the art of wrench making can easily create these additional combinations according to the preference for that particular folding multiwrench design.

In FIGS. 7A and 7B, we see folding multiwrench 170 in top view and side view, respectively in its stowed position with elongated wrench arms 173 and 174 substantially lengthwise adjacent to each other. Multiwrench 170 comprises two quad wrench heads 171 and 172, two elongated wrench arms 173 and 174, and a hinge assembly 175 comprising hinge mounting holes 176, a hinge hole 178, and a pivot pin 177. This design has the same structural configuration as multiwrench 50 seen in FIGS. 2A-B. Wrench heads 171 and 172 are mounted to wrench arms 173 and 174, respectively. Wrench arm 173 has a paw style hinge with mounting holes 176 on the opposite end, and wrench arm 174 has a handle style hinge with mounting hole 178 on its opposite end. Pivot pin 177 connects hinge holes 176 and 178 to form hinge assembly 175. Hinge assembly 175 allows arms 173 and 174 to pivot approximately two-hundred seventy degrees with respect to each other. In this design, the smallest wrench sizes (see prior art bolt heads 179*a* and 179*b* in shadow) are positioned on the top surface of wrench heads 171 and 172 (see FIG. 7A). Of the sizes on the top and bottom of each wrench head, the smaller of the two sizes is placed nearest the outside edge of the wrench head to allow easy turning of the smaller bolts or other smaller rotary fasteners. The larger sizes are overlapped further back from the edge, but because the smaller sizes are placed on the outside, they are not very far from the outer edge of the wrench head. This allows easier access for the wrench to the smaller sized fasteners and reduces the distance larger fasteners must attach to the wrench. The arrangement is a compromise to allow all wrench sizes to work well. In alternative designs, the two smallest sizes can be placed nearest the outside edge of the wrench head so that the two largest sizes are pushed back the least amount from the outside edge of the wrench (see wrench heads 231, 235 and 237 in FIG. 8C).

In other alternate designs, either wrench arm 173 and/or 174 can be bent to the side, so wrench heads 171 and 172 can fold next to each other instead of along the adjacent wrench handle(s), such as wrench design 70 in FIG. 2D. With that arrangement both sides of wrench heads 171 and 172 can be used in the stowed position so that the wrench has a short handle mode and a long, or extended, handle mode.

In FIG. 7C, we see a tri-folding multiwrench 180 in side view, comprising a small wrench head 171, a large wrench head 172, a small elongated wrench arm 181, a large elongated wrench arm 182, an elongated center handle assembly 184 and two hinge assemblies 190 and 195. Wrench heads 171 and 172 are the same as those seen in FIGS. 7A-B and have been mounted on new wrench arms 181 and 182, respectively. Arm 181 connects to hinge assembly 190 at folding hinge 187, and arm 182 connects to hinge assembly 195 at folding hinge 183. Arm 181 also comprises a plurality of friction ridges spaced around hinge 187. Arm 182 also comprises a plurality of locking slots 199 around folding hinge 183. Center handle 184 comprises a center handle body 188, a spring 191, a friction ball 192, and a pivot paw for hinge 187 at one end and a spring 196, a locking pin 198, a thumb control 197 and a second pivot paw for folding hinge 183 at the other end. Arm 181 and wrench head 171 are designed to fold close to center handle body 188 as shown for storage. Arm 182 and wrench head 172 are designed to fold over arm 181 and wrench head 171 on the same side to form a compact configuration for stowage, as seen in FIG. 7C.

In FIG. 7C, hinge assembly 190 comprises a spring 191, friction ball 192, a friction ridges 193, and a folding hinge 187. Spring 191 is designed to force friction ball 192 into friction ridges 193 to hold arm 181 at distinct angles with respect to center handle body 188. The greater the force on spring 191, and the greater the angle of contact between ball 192 and ridges 193, the greater the friction force generated by hinge assembly 190 to hold arm 181 in position. Similarly, hinge assembly 195 comprises a spring 196, a thumb control 197, a locking pin 198, a plurality of locking slots 199, and a folding hinge 183. Spring 196 is designed to force locking pin 198 into locking slots 199 to hold arm 182 at a particular angle with respect to center handle body 188 until the user decides to change its position. Pin 198 locks into one of the locking slots 199 to prevent rotation of arm 182 with respect to center handle body 188. Thumb control 197 is attached to pin 198 so that the user can pull back on thumb control 197 to compress spring 196 and disengage locking pin 198 from locking slot 199, thus allowing arm 182 to be repositioned. This type of locking hinge, and other types of locking hinges, can be used on the other hinges outlined in this patent. The advantage of a locking hinge is that once the user gets the wrench in the desire configuration, it can be locked in place for later use and also will not change angles during use. Range of motion arrows 186*a-b* shown the approximate range of motion for arms 181 and 182, respectively. This range of motion can be greater than one-hundred eighty degrees.

In FIG. 8A, we see an alternate example of a tri-folding multiwrench 200 comprising three quad style wrench heads 201, 205, and 208, three elongated wrench arms 202, 204, and 206, three hinges 203, 203*a*, and 207, and center handle 210. Center handle 210 comprises a center handle body 211, the paw portion of folding hinges 203 and 207, arm slots 212 and 214, and folding slot 213. Wrench heads 201, 205 and 208 are connected to wrench arms 202, 204, and 206 respectively. Wrench head 208 and wrench arm 206 connect to arm 202 at hinge 203*a* and is pivotal through an angle of almost one-hundred eighty degrees. Arm 202 is pivotal around folding hinge 203 with range of motion shown by arrows 209*a*. Arm 204 is pivotal around folding hinge 207 and has a range of motion shown by arrows 209*b*. Wrench heads 201 and 205 slide partially into slots 214 and 213, respectively, to allow a more compact stowed position. Wrench head position 201*a* shows the stowed position of wrench head 201 and arm 202. Wrench head 208 and arm 206 are stored adjacent arm 202 as shown. Wrench head 208 can be folded out for use when wrench head 201 and arm 202 are in their stowed position 201*a*. Notice that the axis of each hinge 203, 203*a*, and 207 (axis perpendicular to the drawing sheet) is substantially perpendicular to all the wrench heads' gripping surface axes (axes in the plane of the drawing sheet, see example gripping surface axes 49*d-g*). This allows the transfer of torque between any arm of the wrench and a rotary fastener in any of the multiwrench head sizes. Slot 212 defines the paw portion of hinge 203 and provides space for the pivotal attachment of arm 202 to center handle 210, and slot 214 defines the paw portion of hinge 207 and allows the pivotal attachment of arm 204 to center handle 210. In this design arms 202 and 204 fold on opposite sides of center handle 210 and arm 206 folds against arm 202.

In FIG. 8B, we see an alternate example of a tri-folding multiwrench 220 comprising two quad style wrench heads 221, and 225, two elongated wrench arms 222 and 224, a center handle 226, two pivot pins 223 and 227, and two folding hinges 226*a-b* (pivot connector). Wrench heads 221 and 225 are mounted to arms 222 and 224, respectively. Center handle 226 comprises a large folding hinge 226*a* (hinge post) on one end and small folding hinge 226*b* (hinge post) on the other end. Pivotal folding hinges 226*a-b* are angled on center handle 226 so that arms 222 and 224 pivotally attach at an angle with respect to the body of center handle 226. With the proper selection of angle for center handle 226, the arms can pivot to a stowed position where arms 222 and 224 are substantially parallel to each other and on the same side of center handle 226. Large arm 222 is pivotally attached to large folding hinge 226*a* with pivot pin 223 and small arm 224 is pivotally attached to folding hinge 226*b* with pivot pin 227. In alternative designs, arms 222 and 224 can fold to opposite sides of center handle 226. Arms 222 and 224 can also be contoured and changed in length to reduce the width of the wrench (see arms 271*a* and 272*a* in FIG. 10A). Multiwrench 220 has two short handle modes: A) where all the wrench sizes are available for used in its stowed position (shown), and B) with only one arm extended. The fully extended mode would be with both arms extended.

In FIG. 8C, we see an alternate example of a tri-folding multiwrench 230 comprising three quad style wrench heads 231, 235, and 237, three elongated wrench arms 232, 234 and 238, a center handle 236, and two hinge assemblies 240 and 245 (folding hinges). Wrench heads 231, 235, and 237 are mounted to arms 232, 234 and 238, respectively. Hinge assembly 240 comprises a spring washer 243 and a pivot pin 241 comprising a threaded end 242, and a driver connector 244. Hinge assembly 245 comprises a spring washer 248, and a pivot pin 246 comprising a threaded end 247, and a driver connector 249. Hinge assemblies 240 and 245 are mounted at opposite ends of center handle 236 with pivot pins 241 and 246, respectively. Pivot pins 241 and 246 use threaded ends 242 and 247 and driver connectors 244 and 249 to screw the pivot pins into matching threads on arms 234 and 232, respectively. In this design, driver connectors 244 and 249 can accept an allen wrench end, or other style connector, for tightening pivot pins 241 and 246 as rotary fasteners. Finally, hinge assemblies 240 and 245 pivotally attaches wrench arms 232, 234 and 238 to opposite ends of center handle 236. Hinge assemblies 240 pivotally attaches wrench arms 234, and 238 to the left end of center handle 236, and hinge assembly 245 pivotally attaches wrench arm 232 to the right end of center handle 236. Spring washers 243 and 248 are fitted over pivot pin 241 and 246, respectively, and are compressed between center handle 236 and the side of its respective wrench arm to generate friction force to help hold the wrench arms in place during use. Notice that multiwrench 230 shown in FIG. 8C is structurally very similar to wrench 220 seen in FIG. 8B, except the bends in the wrench arms 232 and 234 are used to offset the wrench heads instead of bends in the center handle (see center handle 226). Note that wrench arms 232, 234 and 238 when folded to their stowed position (see position 231*a* of wrench head 231) are in a substantially parallel and adjacent position because the longitudinal axes of wrench arms 232, 234 and 238 are within approximately thirty degrees of each other and next to each other in the alternate position 231*a*. If wrench arm 238 is shortened while leaving wrench head at its present side offset, the longitudinal axis of arm 238 will angle more steeply and will not have an angle of less than thirty degrees with the longitudinal axis of arm 232. Multiwrench 230 can still be considered stowed in this folded and compact position with the arms adjacent each other, but arms 232, 234, and 238 would no longer be substantially parallel. If we do not include the third wrench head 237 and arm 238, this combination produces nearly the same orientations of the wrench handles and wrench heads as wrench 220. The multiwrench 230 design can fold all three arms 232, 234 and 238 on the same side of center handle 236. Range of motion arrows 239 show the approximate range of motion for wrench arm 232 out of the page. Wrench arms 232, 234 and 238 can each have a range of motion of more than two-hundred seventy degrees. This particular design has two short handle modes: A) where all the wrench sizes are available for used in its stowed position (wrench head 231 in position 231*a*), and B) with only one arm extended. The fully extended mode would be when arms on both sides of center handle 236 are extended.

In FIG. 9A, we see a perspective view of an open-end quad head wrench 250 comprising an open-end quad wrench head 251, an elongated wrench arm 252, a pivot or hinge connector 258 with a pivot hole 257. Wrench head 251 comprises four separate sized wrench gripping surfaces 253, 254, 255, and 256, in order of smallest to largest. Gripping surfaces 253 and 254 are duplexed with wrench gripping surfaces 255 and 256 to provide four usable sizes. The length of wrench head 251 is shortened by placing outer gripping surfaces 254 and 256 as close as possible to inner gripping surfaces 253 and 255, respectively. The smaller sizes are placed on the inside of the wrench head so that the larger sized rotary fasteners can slide onto the larger sized wrench surfaces. This is the reverse of the box-end style quad wrench heads discussed previously, where the larger sizes are placed on the inside of the wrench head to reduce the distance the smaller wrench sizes are from the end of the wrench (outside edge of the wrench head). The order of wrench sizes is in most cases a matter of preference. In FIG. 9A, wrench gripping surfaces 253, 254, 255, and 256 are shown substantially parallel to each other so that quad wrench head 251 has a relatively low profile. Often with open-end wrenches it is desirable to have the wrench head mounted flat with the wrench handle, as seen in FIG. 9A. However, the gripping surfaces of an open-end quad wrench head can be angles (see wrench heads 261 and 263 in FIGS. 9B-C) just like they can be angled in box-end wrenches (see wrench heads 262 and 264 in FIGS. 9B-C). Similarly, box-end dual and quad wrench heads can be made with non-angled gripping surfaces like wrench head 251.

In FIGS. 9B-C, we see a top view and a side view, respectively, of folding multiwrench 260. Multiwrench 260 comprises four quad wrench heads 261, 262, 263, and 264, four elongated wrench arms 261*a*, 262*a*, 263*a*, and 264*a*, and a hinge assembly 265 comprising a double hinge paw housing 266, a large hinge 268 and a small hinge 267. Wrench heads 261, 262, 263, and 264 are attached to wrench arms 261*a*, 262*a*, 263*a*, and 264*a*, respectively. Two open-end quad wrench heads 261 and 263 provide eight separate open-end gripping surface sizes, and two box-end quad wrench heads 262 and 264 can provide eight wrench gripping surfaces sizes, which can be the same as the eight sizes on heads 261 and 263. Hinge housing 266 can be directly attached to arm 264*a* and supports hinges 267 and 268. Small hinge 267 pivotally attaches arms 261*a* and 262*a* to housing 266, while large hinge 268 pivotally attaches arm 263*a* to housing 266. With this design, arms 261*a*, 262*a*, and 263*a* can pivot one-hundred eighty degrees, or more, away from wrench arm 264*a* to allow any of the wrench heads 261, 262, 263, and 264, to be used separately, while the other wrenches can be used as a wrench handle.

In FIGS. 9B-C, multiwrench 260 can provide eight standard wrench sizes in both open-end and box-end wrench types on the same tool. In alternate designs, two quad wrench heads might provide eight standard SAE sizes, while the other two quad wrench heads might provide eight metric sizes (sixteen sizes total). Because some metric and SAE sizes are the same, a few extra wrench sizes can be added to this type of multiwrench to increasing the actual usable number of sizes to more than sixteen. The design shown in FIG. 9B-C, nests the two larger wrench heads 263 and 264 on the top and nests the two smaller wrench heads 261 and 262 side by side on the bottom. Notice that in this design the longest wrench (arm 264*a*) is the one connected to hinge housing 266 in the middle. In the next design (FIGS. 10A-B), the longest wrench (arm 274*a*) is pivotally attached to the bottom hinge so that all the wrenches can be nested more ergonomically, similar to multiwrench 120 seen in FIGS. 5A-B.

In FIGS. 10A-B, we see a top view and a side view, respectively, of folding multiwrench 270. Multiwrench 270 comprises four wrench heads 271, 272, 273, and 274, four elongated wrench arms 271*a*, 272*a*, 273*a*, and 274*a*, and a hinge assembly 275 comprising a double hinge paw housing 276, a large hinge 278 and a small hinge 277. Wrench heads 271, 272, 273, and 274 are attached to wrench arms 271*a*, 272*a*, 273*a*, and 274*a*, respectively. Two open-end quad wrench heads 272 and 273 provide eight separate sizes of open-end wrench surfaces, and two box-end quad wrench heads 271 and 274 provide eight box-end wrench sizes, which can be the same as the eight sizes on heads 272 and 273. Hinge housing 276 can be directly attached to arm 273*a* and supports hinges 277 and 278. Small hinge 277 pivotally attaches arms 271*a* and 272*a* to housing 276, while large hinge 278 pivotally attaches arm 274*a* to housing 276. With this design, arms 271*a*, 272*a*, and 274*a* can pivot one-hundred eighty degrees, or more, away from wrench arm 273*a* to allow any of the wrench heads 271, 272, 273, and 274, to be used separately, while the other wrenches can be used as a wrench handle.

In FIGS. 10A-B, multiwrench 270 can provide eight standard SAE wrench sizes or eight metric sizes in both open-end and box-end wrench types on the same tool. In alternate designs, two quad wrench heads might provide eight standard SAE sizes, while the other two quad wrench heads might provide eight metric sizes (sixteen sizes total). Because some metric and SAE sizes are the same or very nearly the same size, a few extra wrench sizes can be added to this type of multiwrench to increasing the actual usable number of sizes to more than sixteen. Multiwrench 270 is more compact that multiwrench 260 because all the wrench heads are nested on the same side of the offset wrench heads. Also the two smaller wrench arms 271*a* and 272*a* are more ergonomically contoured to fit in a width not more than wrench head 273 or 274. Notice that in this design the longest wrench (arm 274*a*) is mounted on the bottom at hinge 278. Also, notice that wrench head 271 is inverted with respect to the other wrench heads. This is done to allow wrench head 271 to fit more closely to arm 272*a* because the smaller size section of head 271 is folded next to arm 272*a*. However, this small space savings is only for example and head 271 can easily be inverted to have the same orientation as the other wrench heads 272, 273, and 274 (smaller sized wrench surfaces on top).

In FIG. 10C, folding multiwrench 280 shows that alternate hinge systems can be used (instead of the paw and handle configuration shown in the previous folding wrench examples) to provide an ergonomic pivot assembly for the multiwrench's arms. There are many hinge styles that are well known in the art of hinges and many can be used with the disclosed folding wrenches with only a minor change in the configuration of the wrench arms. Multiwrench 280 shows one such configuration where all the wrench arms are pivotal on the same axis, but the wrench heads still fold into a nested configuration to provide a compact stowed position.

In FIG. 10C, folding multiwrench 280 is shown in perspective view comprising four duplex wrench heads 281, 282, 283, and 284, four elongated wrench arms 285, 286, 287, and 288, and a hinge assembly 290. Arm 285 has wrench head 281 attached at one end and a hinge connector 291 (hinge post) at the other end. Arm 286 has wrench head 282 attached at one end and a hinge connector 292 at the other end. Arm 287 has wrench head 283 attached at one end and a hinge connector 293 at the other end. Arm 288 has wrench head 284 attached at one end and a hinge connector 294 at the other end. Each wrench arm comprises an approximately ninety degree twist between its wrench head and pivot handle. This ninety degree twist does three things: 1) it rotates the axis of the wrench heads so that their turning axis is within ten degrees of being perpendicular with the axis of the hinge assembly 290, thus allowing torque to be transferred across the hinge assembly to one of the other wrench heads, 2) it allows the wrench handles to be folded closely together, and 3) because the handles can be folded closely together, the wrench heads can be nested next of each other to make a compact wrench set. Hinge assembly 290 holds all the wrenches together at hinge connector ends 291, 292, 293, and 294 (hinge post ends) so that each wrench arm pivots around the same axis.

In FIG. 10D, we see hinge assembly 290 comprises a spring washer, a first pivot pin section 297*a* with a threaded hole 296, a second pivot pin section 297*b* with a central passageway for a rotary fastener 298 to pass through, and a pair of matching locking surfaces 299*a-b* on pivot pin sections 297*a-b*, respectively. First and second pivot pin sections 297*a* and 297*b* are designed to pass through hinge connectors 291, 292, 293, and 294, and hold the wrenches in alignment during use. These pivot pins are shown with nearly the same length, but in alternative designs one of the pivot pins can extend through the wrench hinge connectors 291, 292, 293, and 294 with the other pivot pin is not much more than an end cap. Rotary fastener 298 screws into threaded hole 296 to tighten the first and second pivot pin sections 297*a* and 297*b* together and also forces locking surfaces 299*a-b* together so that the two pivot pins can not rotate with respect to one another. This locking action of surfaces 299*a-b* keeps rotary fastener 298 from working loose easily during use. Alternatively rotary fastener 298 can be replaced by a welded or compression fitted pivot pin. Rotary fastener 298 also compressing spring washer 295 against the inner rim of the first pivot pin section 297*a* and the outside surface of hinge connector 291. This compression force from spring washer 295 forces all the hinge connectors 291, 292, 293, and 294 together to provide a consistent friction force to help hold all the wrench arms in place during use.

In FIG. 10C-D, the design of hinge 290 was chosen because it clearly shows four pivot handles on a single hinge. However, in an alternative design, pivot pin sections 297*a-b* can be made integral with hinge post end 294 (pivot pin can be welded, drop forged, etc. onto hinge post 294). If the pivot pin is built into the pivot handle (arm 288) from one piece of metal, the structural strength of the hinge can be improved. With this alternative arrangement the pivot pin becomes part of arm 288 to which hinge connector ends 291, 292, and 293 are pivotally mounted. The operation of this alternative design would be the same as the wrench shown in FIGS. 10C-D except the pivot pin would now rotate with wrench arm 288, and the width of hinge assembly 290 would be slightly reduced.

The reader should understand from the above folding multiwrench examples that many combinations and configurations are possible. By combining different wrench styles, wrench types, and wrench gripping surfaces, a multitude of additional wrench configurations can be provided, including many special purpose folding multiwrenches. The placement of hinges and wrench heads can provide many functions for the multiwrench, including, but not limited to, a stowed position for storage, a stowed handle position where all the wrenches are operational and function as a handle at the same time, a short handle position, an extended handle position, and an operational position. It should be understood that the stowed handle and short handle position are not available on all multiwrench designs disclosed in this patent. The stowed position is an advantage because the multiwrench can be folded up into compact, pocket-friendly form. The short handle position allows the wrench to get into tighter places that a full size wrench would not fit. The extended handle position provides the user maximum torque and leverage for loosening stuck fasteners. In the operational position the wrench head is positioned for use. With the folding multiwrench all wrench sizes can be permanently connected to the multiwrench, eliminating any chance of losing one of the wrench sizes, and the user will always have the wrench size they need.

Operational Description

All the folding multiwrenches presented in this patent operate generally in the same way. The user pivots the wrench head they want to use into the open and use that wrench head to turn a rotary fastener, while one or more of the other wrench heads and wrench arms act as the handle. The specific operations of each multiwrench design is a little more complicated than this, so I will explain in more detail.

The individual wrenches in the folding multiwrenches presented in this patent operate very much like a standard wrench. However, the multiwrench design is more ergonomic because it can fold up into a compact form. If multi-size wrench heads are used the multiwrench can fold even smaller. Multi-sized wrench heads operate slightly differently depending on its style and type. The actual act of using the wrench head amounts to nothing more than engaging a rotary fastener with the wrench gripping surface for that size fastener, and is well understood by most people. However, the different modes and positions for the arms and wrench heads is less obvious and will be discussed them here.

Along with the standard operation of a wrench, each wrench (wrench arm and wrench head) can be used in four functional modes: 1) in a stowed position, 2) in a stowed position which is also an operational position, 3) a short handle position, and 4) an extended handle position. This list does not include the fact that each of the pivoting arms can be rotated to a multitude of angles to provide many additional modes between each of these four major functional modes. For example, the wrench arms might be angled to allow a wrench head to reach an awkwardly positioned bolt head. Normally this would require a specialty wrench, but because of the variety of angles possible, the folding multiwrenches disclosed here can simulate a number of curved and strangely shaped wrenches.

The specific operation of the multiwrenches depend greatly on the number of segments in the wrench. For example, if only a single hinge assembly is used where all the wrench arms attach at this hinge, the wrenches will fold out similar to the binding on a book and operation is simply rotating the wrench desired into the open for use. This arrangement of wrench arms and pivotal hinges can allow the multiwrench to function in three of the modes: 1) in a stowed position, 2) in a stowed position which is also an operational position, 3) an extended handle position, and 4) extended for use position. In many cases, the extended handle position will be the same as the extended for use position. The short handle mode is not available because the wrench goes directly to an extended handle position when unfolded. If two separate hinge assemblies on a center handle are used we can have what I have called a tri-fold wrench where the wrench unfolds similar to a tri-fold brochure, with the arms rotating away from the center handle for use. In this type of arrangement, a tri-fold multiwrench can have five distinct positions for the wrench arms: 1) in a stowed position for storage, 2) a stowed position which also allows operation of the wrenches (very short handle) at the same time, 3) a short handle position where the wrench is partially extended, 4) an extended handle position where the wrench is fully extended, and 5) an extended for use position. Each of these distinct functional positions can have a range of angles for the wrench's arms (and attached wrench heads) that allow each function. Each wrench head has a stowed position for its wrench heads that provide a compact stowed configuration. Each wrench head can have one or more operational positions and one or more handle positions. In any particular operation, when one wrench head is being used, the other wrench head and wrench arms can be used as the handle for the multiwrench. Because of the pivotal nature of the wrench arms, many different angle configurations can be created for the arms and wrench heads. In this way, each wrench arm and attached head has three basic functional positions (stowed, handle, and wrench). Each of these functional positions will be discussed in the proceeding sections.

Wrench Operation

Though not discussed specifically here, the use of the wrench heads themselves is common knowledge. The wrench gripping surface is placed in contact with the rotary fastener's head and a torque is applied to the wrench handle to turn the fastener. Because many of the wrench heads disclosed for use with the folding multiwrench have wrench sizes on both sides of the wrench head, the user must turn the wrench head over to access the other wrench sizes. Many wrench heads now include ratchet systems which can be single-direction ratchets, or reversible two-direction ratchets. Because the disclosed multiwrenches can use duplexed wrench heads, and quad wrench heads, a ratchet built for these wrench heads needs to be of the reversible type (see FIG. 6B) so that the wrench sizes on both sides of the wrench head can both loosen and tighten a rotary fasteners.

Stowed Positions (FIGS. 2B-D, 3B-C, 4A, 5A-B, 6A, 6C, 7A-C, 8B, 9B-C and 10A-B)

One of the major advantages of the disclosed folding multiwrenches is that they can be stowed in a compact, pocket ready form. The stowed position can be minimize the overall size of the wrench set by moving the arm close to one another and moving the attached wrench heads against one another, next to one another, or nested with one another. Not all multiwrench examples shown in this patent are in their most compact form, but someone skilled in engineering should be able to determine a more compact configuration from this discussion. Another advantage of providing a compact folding wrench with a full set of wrench sizes is that the wrenches are permanently attached to each other and cannot be individually lost.

In FIGS. 2B-D, 3B-C, 4A, 5A-B, 6A, 6C, 7A-C, 8B, 9B-C and 10A-C, we see examples of folding multi-wrenches in their folded and stowed position. Notice that many different ways exist for folding up a set of wrenches. All the folding multiwrenches have at least one compact configuration that we will call the stowed position. Most of the drawings in this patent show multiwrenches in their stowed position because it takes less space on the drawing sheets. But, wrench arms' alternate positions are easy to calculate since the hinges for these wrench arms are identified, and in many drawings the rotational range of the wrench arms are estimated by double arrow lines.

Stowed Operation

A number of multiwrench designs disclosed in this patent can be used when in their stowed position. This operation while stowed give the user a short handle configuration to get into small spaces with the wrench. Multiwrenches 60, 70, 160, 220, and 230 seen in FIGS. 2C, 2D, 6C, 8B, and 8C, respectively, can use all their wrench sizes while in their stowed positions. The other designs only have some of their wrench sizes exposed when in their stowed position. Multiwrenches 70, 220 and 230 seen in FIGS. 2D, 8B and 8C, respectively, expose all their wrench sizes in their one stowed position so that the wrench can be used in these short stowed positions. Other configurations like multiwrenches 60 and 160 have two stowed operation positions to allow all its wrench sizes to be used. Multiwrench 60 seen in FIG. 2C can have two stowed position. The first stowed position is shown in solid lines and the second stowed position is shown in shadow lines marked 61*a* and 65*a*. By combining these two stowed positions, wrench 60 can expose all its wrench sizes so that they all can be used while in one or the other stowed positions. Also, multiwrench 160 seen in FIG. 6C can have two stowed positions. The first stowed position is shown in solid lines and the second stowed position is achieved by the arrangement shown in shadow lines and then pivoting arm position 168*a* clockwise until it rests against arm 166. This second compact stowed position allows wrench heads 165*a-b* to be used while stowed. The first stowed position, shown in solid lines, allows wrench heads 161*a-b* to be used while stowed. Thus, the entire wrench set can be used while in the two stowed positions. This need for two stowed positions is eliminated in designs like multiwrenches 70, 220, and 230, seen in FIGS. 2D, 8B, and 8C, respectively, where all the wrench heads' sizes are exposed while in a single stowed position. Notice that the tri-fold wrenches 220 and 230 can provide a shorter stowed position than bi-fold wrenches 60, 70, and 160 (closely spaced double hinge folding) for the same extended length wrench position. Multi-hinge bi-fold wrench 160 is even longer than the simple single hinge bi-folds since its short center handle 164 adds slightly to the overall length of the stowed position.

Short Handle Operation (FIGS. 3*a*, 3*b*, 3*c*)

Only the tri-fold wench designs can use the short handle position because these designs can fold out in two stages. The short handle position is an intermediate handle length between the stowed position and the fully extended position. FIGS. 4A through 4C show the progression of tri-fold multiwrench 110 folding out from the stowed position in FIG. 4A, to a short handle position in FIG. 4B, to a fully extended positions shown in FIG. 4C. In FIG. 4B, wrench arm 112 and center handle 117 act as the handle for wrench arm 114 and wrench head 115. Similarly if wrench arm 114 was folded to its stowed position and arm 112 were folded out to an extended position (see FIG. 4C) then arm 114 would act as the handle for wrench arm 112 and head 111. Each of the tri-fold designs disclosed herein can provide this intermediate length handle operation.

Long Handle Operation (FIGS. 2C, 3B, 4C, 3B, 3C, 4B, 5A, 6C, 7C, 8A-C, and 10C)

All of the multiwrenches disclosed in this patent have a long handle position for the wrench arms. For the bi-fold wrenches (see FIGS. 2A-B, 2C, 2D, 3A, 3B, 3C, 5A-B, 6A, 6B, 6C, 7A-B, 9B-C, and 10A-C) the wrenches go into long handle position when any of the wrench arms are pivoted out for use. This is because the other wrench arms then become the extended (long position) handle. For bi-fold wrenches with a hinge housing having two hinges (see FIGS. 3B, 3C, 5A-B, 6B, 9B-C, and 10A-B) the center wrench can be used by pivoting all the other wrench arms to the opposite side of their stowed position so that they act as the extended handle (long handle position) for the center wrench heads 91, 102, 123, 151, 264, and 273, respectively. For the tri-fold wrenches (see FIGS. 4A-C, 7C, 8A, 8B, and 8C) at least one wrench arms on each side of the center handle needs to be folded out for the wrench to reach its fully extended position. Once fully extended tri-fold multiwrenches can use either extended arm as the wrench handle or the wrench head depending on which wrench arm the user grips.

The above operational description are sufficient for most mechanically inclined people, not only to understand how to use the multiwrenches, but also how they can be constructed to achieve these operational abilities. However, I would still like to discuss in the next few paragraphs a few subtle points about the operation of specific multiwrench examples.

In FIGS. 4A through 4C we see the progression of a tri-folding multiwrench be unfolded. In its fully extended position in FIG. 4C, head 111 and arm 112 can act as either the handle or the wrench for the multiwrench. Similarly, head 115 and arm 114 can act as either the wrench or the handle, depending on which end is gripped. In FIG. 4C we see multiwrench 110 fully extended, with two positions for arm 112 and head 111. The first position is shown in solid lines and the second position is shown in shadow lines marked 111*a*. Both these position can use arm 112 and head 111 as either a handle for wrench head 115, or the wrench for the handle formed by arm 114 and head 115.

In FIG. 5A-B, we see multiwrench 120 which has four separate wrench heads 121, 122, 123 and 124 that can each be used separately while the other wrenches are used as the handle. For example, each wrench arm 125, 126, and 128 an their respective wrench head 121, 122, and 124, respectively, can be pivoted individually away from the rest of the wrench arms and heads (see pivoted shadow position 124*c* for arm 128 and wrench head 124). The remaining arms and wrench heads can then be used as an extended handle for the pivoted wrench. However, because wrench arm 127 is attached directly to hinge housing 134, it can not pivot away from the other arms like the other arms can. Also because it is located between the other arms the other arms would get in the way anyway. So to use arm 127 and wrench head 123 each of the other wrench arms 125, 126, and 128 are pivoted to the opposite side where they can come together and function as a handle for arm 127 and wrench head 123, which is now by itself on the other side of hinge assembly 130. The multiwrenches seen in FIGS. 3B, 3C, 6B, 9B-C, and 10A-B operate in essentially the same way, with the pivotal arms pivoting to the opposite side of the hinge to use the non-pivoting wrench that is attached to the hinge housing. In alternative designs the wrench arms that are shown fixed directly to the hinge housing (see FIGS. 3B, 3C, 5A-B, 6B, 9B-C, and 10A-B), can be mounted to an additional hinge on the hinge housing (so there are three hinges). The operations would remains substantially the same with the center wrench pivotally attached to the center hinge, and still requires the other wrenches to be pivoted to the other side to use the center wrench.

In FIG. 6C, we see multiwrench 160 using Figure-8® style wrench heads 161*a-b* and 165*a-b*. During use, each of these Figure-8® style wrench heads can be pivoted individually to an extended position for use. Each of the wrench heads can pivot a full three-hundred sixty degrees and can rotate passed each other. Because center handle 164 is pivotally attached between arms 162 and 166, the wrench has two stable stowed positions. In the first stowed position, shown in solid lines in FIG. 6C, the large wrench heads 161*a-b* can extended slightly out passed the smaller wrench heads 165*a-b*. This allows both of the large wrench heads 161*a-b* to be used in this stowed position simply by pivoting the desired wrench head to the desired angle for use. However, in this first stowed position the smaller wrench heads 165*a-b* are partially blocked from use by the larger wrench heads 161*a-b*. To use the smaller wrench heads, the center handle 164 can be pivoted to the right as shown by shadow line 168*b* and arm 162 folding against arm 166. This will place the small wrench heads 165*a-b* extended slightly passed the larger wrench heads 161*a-b*. This allows the smaller wrench heads 165*a-b* to clear wrench head 161*a-b* and be use to turn fasteners in this second stowed position.

In FIG. 7C, we see tri-fold multiwrench 180 showing a friction hinge assembly 190 and a locking hinge assembly 195. Friction hinge assembly 190 is a common design on pivot wrench heads and especially on pivoting ratchet wrenches, where spring 191 forces ball 192 against ridges 193 to help hold arm 181 in place relative to center handle body 188. Locking hinge assembly 195 operates similar to a large number of wrench arm locking mechanisms, where spring 196 forces thumb control 197 and locking pin 198 into one or more slots in locking slots 199 on arm 182. Spring 196 keeps pin 198 engaged with slots 199 to prevent arm 182 from rotating around hinge 183. To release arm 182, the user pushes thumb control 197 back toward spring 196, which disengages pin 198 from slots 199. Once disengaged, arm 182 can pivot freely to a new angle, where the user releases thumb control 197, and pin 198 once again engages slots 199 to lock arm 182 in its new orientation. Many other similar, and not so similar, prior art locking systems (i.e. selectively engaging and disengaging the hinge) can be used with the disclosed multiwrench designs to provide temporary locking of the wrench arms at a user selected angle. This can provide ergonomic benefits in certain situations.

In FIG. 8A, we see multiwrench 200 with wrench head 201 comprising four wrench gripping surface axes 49*d*, 49*e*, 49*f*, and 49*g*. Wrench head 201 is an overlapped duplexed box-end wrench head which has four different sized wrench surfaces as shown by wrench head 231 in FIG. 8C, but can be similar to quad wrench head 40 in FIGS. 1D-E, or wrench head 172 in FIG. 7A-C. Because the four engaging wrench surfaces are offset in a overlapped duplexed arrangement, the rotational axes for fasteners being turned are located in slightly different places on each sides of wrench head 201. The wrench gripping surfaces layout of wrench head 231, in FIG. 8C, will be used for wrench head 201. With wrench head 201, the gripping surfaces have the two smallest sized wrench surfaces placed on the front edge of the wrench head, with one on the top and one on the bottom (instead of both smaller sizes on the bottom portion of wrench head like wrench heads 221 and 225 in FIG. 8B). Thus, axis line 49*d*, in FIG. 8A, represents the rotational axis for a fastener attached to the smallest size gripping surface on wrench head 201. Axis line 49*e*, represents the rotational axis for a fastener attached to the next largest gripping surface on wrench head 201. Axis lines 49*f*, and 49*g*, represents the attachment axis for a fasteners attached to the two largest gripping surface on wrench head 201. By placing the smaller wrench sizes on the outside of wrench head 201 the overall distance between a fastener and the outermost edge of the wrench head can be reduced compared to placing the larger wrench sizes on the outside as must be done with open-end wrenches (see wrench 250 in FIG. 9A). Note that the prior art example quad wrench head 40 in FIGS. 1D-E place the larger wrench sizes on the outside, which causes smaller wrench sizes to be a considerable distance away from the outer end (outer edge) of the wrench head. This significantly reduces the number of situations where the smaller wrench sizes can be used Placing the larger wrench sizes on the inside reduces this gap in two ways: 1) the smaller wrench surface on the outside has a smaller diameter so it moves the larger diameter wrench surface a shorter distance from the outer edge of the wrench head, and 2) because of the larger diameter of the larger wrench surface the larger fastener extends closer to the outer edge of the wrench head anyway. This results in the smaller wrench sizes having almost no additional space compared to a standard single size box-end wrench between the wrench gripping surfaces and the outer edge of the wrench head, and only a small additional space for the larger wrench sizes. Thus, this configuration for this quad head arrangement is more useful than the shown prior art.

In FIG. 10C, we see an alternative example for placing four or more wrenches on a single hinge. The configuration seen in multiwrench 280 is an adaptation of folding multiwrench 80 seen in FIG. 3A, with a pivot pin hinge that is not directly attached to any of the wrench arm hinge connectors 291, 292, 293, and 294. Because all the wrench arms are pivoted on the same hinge assembly 290, its operation is slightly different than the other designs presented in this patent. Each of the four wrench heads 281, 282, 283, and 284 are nested on top of one another so that the wrench stows in a compact format. Also each of the four wrench arms 285, 286, 287, and 288 are designed to nest adjacent one another so that the wrench heads can be nested on top of its next larger wrench arm. This allows the wrench heads to be stowed closer to one another for a more compact multiwrench. To use one of the wrenches, that particular wrench is separated from the rest by pivoting the other wrenches and their arm away from the wrench to be used. Only the largest and smallest wrench heads 281 and 284 can be directly pivoted to the opposite side for use. The other two wrench heads 282 and 283 are prevented from pivoting by themselves by wrench heads 281 and 284 and their arms. Thus, to use wrench heads 282 and 283, the other three wrenches are pivoted one-hundred eighty degrees to the opposite side, where they form a handle for the remaining un-pivoted wrench head. For example, to use wrench head 283 on arm 287, wrench heads 281, 282, and 284 can be pivoted away from wrench head 283 and brought back together on the opposite side of the hinge assembly to form an extended handle for wrench head 283. The user would then grip the handle formed by wrench heads 281, 282, and 284, and arms 285, 286, and 288 and use them to apply torque to wrench head 283. This torque can be easily transferred through the hinge assembly 290 because the hinge axis is substantially perpendicular to the axes of the wrench heads. Ideally, the hinge and wrench head axes can be less than ten degrees off from perpendicular to allow easier operation. In alternate designs, wrench heads 281, 282, 283, and 284 can pivot past each other so that each wrench head can be quickly pivoted by itself for use. However such an alternate design would tend to be wider than multiwrench 280 shown.

Ramifications, and Scope

The disclosed folding multiwrench provides a full wrench set in a convenient folding tool that can weigh one-eighth as much as a complete standard set of similar wrenches. The use of pivoting wrench arms that can operate both as a wrench or a handle for the multiwrench, provide the ability for the multiwrench to fold up into a very compact tool that can fit in a user's pocket. These structures can provide five distinct functional modes for each arm and wrench head depending on the positioning of the wrench heads and hinge(s): 1) a stowed position for storage, 2) an operational stowed position (some designs), 3) a short handle position (some designs), 4) a operational position for turning a rotary fastener, and 5) a fully extended position were the arm acts as an extended handle.

Although the above description of the invention contains many specifications, these should not be viewed as limiting the scope of the invention. Instead, the above description should be considered illustrations of some of the presently preferred embodiments of this invention. For example, it should be obvious from the above discussion that the wrench examples in FIGS. 2A through 10C can be used with standard single size wrench heads. Multi-sized wrench heads are preferred in these examples because they provide greater functionality for nearly the same size wrench set, but using single size wrench heads is an option. Other embodiments can comprise additional pivot hinges placed between the ends of the wrench arms to provide additional folding of the wrench. Also many different shapes are possible for the arms and handles to provide various ergonomic advantages and the arm and handle shapes shown here are only examples of the many shapes possible. The reader should further understand that all the disclosed folding multiwrenches can comprise a locking mechanism that can selectively engage and disengage the hinges' pivoting action. The wrench hinges can use any number of locking mechanisms or friction creating mechanisms without effecting the general functionality of the invention, and nearly any sturdy prior art hinge mechanism style can be used with the disclosed invention.

Thus, the scope of this invention should not be limited to the above examples but should be determined from the following claims.

I claim:

1. A folding multiwrench for applying torque to a plurality of different sized rotary fasteners, comprising:

a) a first elongated wrench arm providing a first wrench head at a first end and an axial twist of about ninety degrees extending between the first wrench head and a second end of the first elongated wrench arm, wherein the first wrench head defines two or more first gripping surfaces each with a rotational axis and designed to engage and apply torque to at least two different sizes of rotary fasteners; and b) a second elongated wrench arm providing a second wrench head at a first end and an axial twist of about ninety degrees extending between the second wrench head and a second end of the second elongated wrench arm, wherein the second wrench head defines two or more second gripping surfaces each with a rotational axis and designed to engage and apply torque to at least two different sizes of rotary fasteners, c) wherein the second ends of the first and second elongated wrench arms are pivotally attached along a first hinge axis to form a first hinge and the first and second elongated wrench arms are pivotable around the first hinge axis to an extended position, where each of the elongated wrench arms can alternately be used as a gripping handle to apply torque to the other elongated wrench arm, and pivotable to a stowed position, where the elongated wrench arms nest laterally adjacent one another and the second wrench head nests at least partially on top of the first wrench arm, whereby the stowed position is significantly shorter in length than the extended position, and d) wherein the rotational axes of the two or more first gripping surfaces and the two or more second gripping surfaces are substantially perpendicular to the first hinge axis.

2. The folding multiwrench in claim 1, wherein during use the first hinge axis is within ten degrees of being perpendicular to the rotational axes of the two or more first gripping surfaces and the two or more second gripping surfaces.

3. The folding multiwrench in claim 1, wherein the first and second wrench heads are selected from the group consisting of an adjustable wrench head, a duplexed gripping surfaces wrench head, an overlapped gripping surfaces wrench head, a dog bone wrench head, a figure-eight wrench head, and an overlapped and duplexed wrench head.

4. The folding multiwrench in claim 1, wherein the first and second elongated wrench arms define first and second longitudinal axes, respectively, and wherein the first and second longitudinal axes are substantially parallel to each other when the first and second elongated wrench are in the stowed position.

5. The folding multiwrench in claim 1, wherein the first and second elongated wrench arms define first and second longitudinal axes, respectively, and wherein the rotational axes of the first and second gripping surfaces are substantially perpendicular to the first and second longitudinal axes, respectively.

6. The folding multiwrench in claim 1, further comprising a third elongated wrench arm providing a third wrench head at a first end and an axial twist of about ninety degrees extending between the third wrench head and a second end of the third elongated wrench arm, wherein the third wrench head defines two or more third gripping surfaces each with a rotational axis and designed to engage and apply torque to at least two different sizes of rotary fasteners, wherein the second end of the third elongated wrench arm is pivotally attached along the first hinge axis and the rotational axes of the two or more third gripping surfaces are substantially perpendicular to the first hinge axis, and wherein the third elongated wrench arm is pivotable to a stowed position where the third elongated wrench arm nests laterally adjacent the first and second elongated wrench arms and the third wrench head nests at least partially on top of the second wrench arm.

7. The folding multiwrench in claim 1, wherein the first and second wrench heads are fully usable in the stowed position, whereby the folding multiwrench can be used as a short handled wrench.

8. The folding multiwrench in claim 1, further comprising a third elongated wrench arm providing a third wrench head at a first end, wherein the third wrench head defines one or more third gripping surfaces and a second end of the third elongated wrench arm is pivotally attached to the first hinge.

9. The folding multiwrench in claim 1, further comprising:

a third elongated wrench arm providing a third wrench head at a first end and an axial twist of about ninety degrees extending between the third wrench head and a second end of the third elongated wrench arm, wherein the third wrench head defines two or more third gripping surfaces each with a rotational axis and designed to engage and apply torque to at least two different sizes of rotary fasteners;

a fourth elongated wrench arm providing a fourth wrench head at a first end and an axial twist of about ninety degrees extending between the fourth wrench head and a second end of the fourth elongated wrench arm, wherein the fourth wrench head defines two or more fourth gripping surfaces each with a rotational axis and designed to engage and apply torque to at least two different sizes of rotary fasteners, wherein the second ends of the third and fourth elongated wrench arms are pivotally attached along a second hinge axis to form a second hinge; and a center handle providing a first hinge paw at a first end and pivotally attached along the first hinge axis to the first and second wrench arms, and further providing a second hinge paw at a second end of the center handle and pivotally attached to the second ends of the third and fourth elongated wrench arms along the second hinge axis, wherein the third and fourth elongated wrench arms are pivotable around the second hinge axis to an extended position, where the third and fourth elongated wrench arms can alternately be used as a gripping handle to apply torque to the other elongated wrench arm, and pivotable to a stowed position, where the third and fourth elongated wrench arms nest laterally adjacent one another and the fourth wrench head nests at least partially on top of the third wrench arm.

10. The folding multiwrench in claim 9, further comprising a hinge locking mechanism incorporated into at least one of the first and second hinges to selectively lock one or more of the first, second, third, and fourth elongated wrench arms at a specific angle with respect to the center handle.

11. A folding multiwrench for applying torque to a plurality of different sized rotary fasteners, comprising:

a) a first elongated wrench arm providing a first wrench head at a first end and an axial twist of about ninety degrees extending between the first wrench head and a second end of the first elongated wrench arm, wherein the first wrench head defines two or more first gripping surfaces each with a rotational axis, and wherein the first wrench head is designed to engage and apply torque to at least two different sizes of rotary fasteners;

b) a second elongated wrench arm providing a second wrench head at a first end and an axial twist of about ninety degrees extending between the second wrench head and a second end of the second elongated wrench arm, wherein the second wrench head defines two or more second gripping surfaces each with a rotational axis, and wherein the second wrench head is designed to engage and apply torque to at least two different sizes of rotary fasteners;

c) a third elongated wrench arm providing a third wrench head at a first end, wherein the third wrench head defines two or more third gripping surfaces each with a rotational axis, and wherein the third wrench head is designed to engage and apply torque to at least two different sizes of rotary fasteners; and d) a center handle having a first end pivotally attached to the second ends of the first and second elongated wrench arms along a first axis and thereby forming a first hinge, and a second end pivotally attached to a second end of the third elongated wrench arm along a second axis and thereby forming a second hinge, wherein the first axis is substantially parallel to the second axis, whereby the first, second, and third elongated wrench arms can pivot to multiple positions with respect to the center handle, e) wherein the first and second elongated wrench arms are pivotable to an extended position, where the first and second elongated wrench arms can alternately be used as a gripping handle to apply torque to the other elongated wrench arm, and further pivotable to a stowed position, where the first and second elongated wrench arms nest laterally adjacent to one another and adjacent the center handle, wherein the stowed position is significantly shorter in length than the extended position, and f) wherein the rotational axes of the first and second gripping surfaces are substantially perpendicular to the first and second axes.

12. The folding multiwrench in claim 11, further comprising:

a fourth elongated wrench arm providing a fourth wrench head at a first end and an axial twist of about ninety degrees extending between the fourth wrench head and a second end of the fourth elongated wrench arm, wherein the second end of the fourth elongated wrench arm is pivotally attached along the first hinge axis and wherein the fourth elongated wrench arm is pivotable to a stowed position where the fourth elongated wrench arm nests laterally adjacent the second elongated wrench arm and the fourth wrench head nests at least partially on top of the second elongated wrench arm.

13. The folding multiwrench in claim 11, wherein the first and second wrench head comprises either heads are selected from the group consisting of an adjustable wrench head, a duplexed gripping surfaces wrench head, an overlapped gripping surfaces wrench head, a dog bone wrench head, a figure-eight wrench head, an overlapped and duplexed wrench head, and any combination thereof.

14. The folding multiwrench in claim 11, wherein the first and second elongated wrench arms define first and second longitudinal axes, respectively, and wherein the first and second longitudinal axes are substantially parallel to each other when the first and second elongated wrench arms are in the stowed position.

15. The folding multiwrench in claim 11, wherein the first and second elongated wrench arms define first and second longitudinal axes, respectively, and wherein the first and second longitudinal axes are substantially parallel to a longitudinal axis of the center handle when the first and second elongated wrench arms are in the stowed position.

16. The folding multiwrench in claim 11, wherein the first and second elongated wrench arms define first and second longitudinal axes, respectively, and wherein the rotational axes of the first and second gripping surfaces are substantially perpendicular to the first and second longitudinal axes, respectively.

17. The folding multiwrench in claim 11, wherein the center handle is an elongated center handle comprising a longitudinal length that is greater than ninety percent of a length of at least one of the first and second elongated wrench arms, and wherein the first and second elongated wrench arms fold to opposite sides of the elongated center handle when in the stowed position.

18. The folding multiwrench in claim 11, wherein the third elongated wrench arm includes an axial twist of about ninety degrees extending between the third wrench head and the second end of the third elongated wrench arm, the folding multiwrench further comprising:

a fourth elongated wrench arm providing a fourth wrench head at a first end and an axial twist of about ninety degrees extending between the fourth wrench head and a second end of the fourth elongated wrench arm pivotally attached to along the second hinge axis, wherein the fourth wrench head defines two or more fourth gripping surfaces each with a rotational axis, and wherein the fourth wrench head is designed to engage and apply torque to at least two different sizes of rotary fasteners, wherein the third and fourth elongated wrench arms are pivotable around the second hinge axis to an extended position, where the third and fourth elongated wrench arms can alternately be used as a gripping handle to apply torque to the other elongated wrench arm, and pivotable to a stowed position, where the third and fourth elongated wrench arms nest laterally adjacent one another and the fourth wrench head nests at least partially on top of the third wrench arm.

19. The folding multiwrench in claim 18, further comprising a hinge locking mechanism incorporated into at least one of the first and second hinges to selectively lock one or more of the first, second, third, and fourth elongated wrench arms at a specific angle with respect to the center handle.

* * * * *